US012727643B2

(12) United States Patent
Peter et al.

(10) Patent No.: US 12,727,643 B2
(45) Date of Patent: Sep. 8, 2026

(54) SOLE COMPRISING REINFORCING FRAME

(71) Applicant: adidas AG, Herzogenaurach (DE)

(72) Inventors: Benjamin Peter, Herzogenaurach (DE); Ulisse Matthias Tanzini, Nuremberg (DE); Francisca Paredes, Nuremberg (DE); Niklas Nester, Nuremberg (DE); Peter Valdivia, Nuremberg (DE); Melanie Astudillo, Nuremberg (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/926,971

(22) Filed: Oct. 25, 2024

(65) Prior Publication Data

US 2025/0143406 A1 May 8, 2025

(30) Foreign Application Priority Data

Nov. 3, 2023 (DE) ..... 10 2023 210 927.1

(51) Int. Cl.
*A43B 13/12* (2006.01)
*A43B 5/06* (2022.01)
*A43B 13/14* (2006.01)

(52) U.S. Cl.
CPC ..... *A43B 13/127* (2013.01); *A43B 5/06* (2013.01); *A43B 13/145* (2013.01)

(58) Field of Classification Search
CPC ... A43B 13/127; A43B 13/145; A43B 13/026; A43B 13/181; A43B 13/185
USPC ..... 36/107, 108
See application file for complete search history.

(56) References Cited

U.S. PATENT DOCUMENTS 6,502,330 B1 * 1/2003 David ..... A43B 13/12 36/43
7,263,788 B2 9/2007 Johnson
8,479,413 B2 * 7/2013 Avent ..... A43B 13/12 36/108
8,984,775 B2 3/2015 Dombrow
10,842,224 B2 11/2020 Farina et al.
2001/0010129 A1 * 8/2001 Russell ..... A43B 13/12 36/129
2003/0000109 A1 1/2003 Kita
2003/0172548 A1 * 9/2003 Fuerst ..... A43B 13/026 36/28
2004/0154188 A1 8/2004 Laska
2009/0013556 A1 * 1/2009 Nishiwaki ..... A43B 13/181 36/28
2009/0019730 A1 * 1/2009 Salminen ..... A43B 7/1425 36/102

(Continued)

FOREIGN PATENT DOCUMENTS

EP 1 002 473 B1 7/2003
EP 3 868 242 A2 8/2021

(Continued)

*Primary Examiner* — Jameson D Collier
(74) *Attorney, Agent, or Firm* — Sterne, Kessler, Goldstein & Fox P.L.L.C.

(57) ABSTRACT

A sole for a shoe, in particular for a sports shoe, such as a running shoe, the sole including a midsole and a reinforcing frame, wherein at least a first part of the reinforcing frame substantially surrounds an outer boundary of the midsole in one or more of: a lateral side region, a medial side region, a heel region, and a toe region of the midsole thereby defining an open space such that a part of the midsole is received in the open space.

21 Claims, 7 Drawing Sheets

(56) References Cited

U.S. PATENT DOCUMENTS

| | | | | |
|---|---|---|---|---|
| 2010/0307028 | A1* | 12/2010 | Teteriatnikov | A43B 13/145 36/108 |
| 2011/0088287 | A1 | 4/2011 | Auger et al. | |
| 2011/0277355 | A1* | 11/2011 | Fahmi | A43B 13/42 36/30 R |
| 2012/0233877 | A1* | 9/2012 | Swigart | A43B 7/142 36/28 |
| 2017/0079373 | A1* | 3/2017 | Huard | A43B 7/144 |
| 2018/0116335 | A1 | 5/2018 | Worobets et al. | |
| 2020/0022455 | A1* | 1/2020 | Eldem | A43B 13/206 |
| 2020/0305541 | A1* | 10/2020 | Yahata | A43B 13/127 |
| 2021/0093039 | A1 | 4/2021 | Paterson et al. | |
| 2021/0112918 | A1* | 4/2021 | Schulten | A43B 13/026 |
| 2021/0259357 | A1 | 8/2021 | Paterson et al. | |
| 2021/0259358 | A1 | 8/2021 | Paterson et al. | |
| 2021/0368916 | A1* | 12/2021 | Wakasugi | A43B 13/14 |
| 2022/0061457 | A1 | 3/2022 | Girard et al. | |
| 2022/0125158 | A1* | 4/2022 | Ni | A43B 13/18 |
| 2022/0378147 | A1 | 12/2022 | Bruns et al. | |
| 2023/0240408 | A1* | 8/2023 | Sakaguchi | A43B 7/24 36/30 R |
| 2024/0206588 | A1* | 6/2024 | Chen | A43B 3/0073 |

FOREIGN PATENT DOCUMENTS

| | | | |
|---|---|---|---|
| EP | 2 649 896 | A2 | 10/2023 |
| JP | 2022079271 | A | 5/2022 |
| JP | 2024151558 | A | 10/2024 |
| KR | 10-2097381 | B1 | 4/2020 |
| WO | WO 2011/031363 | A1 | 3/2011 |
| WO | WO 2016/030026 | A1 | 3/2016 |
| WO | WO 2016/030333 | A1 | 3/2016 |
| WO | WO-2021/260920 | A1 | 12/2021 |

* cited by examiner

SOLE COMPRISING REINFORCING FRAME

CROSS-REFERENCE TO RELATED APPLICATION

This application claims priority to German Patent Application No. 102023210927.1, filed Nov. 3, 2023, which is incorporated by reference herein in its entirety.

TECHNICAL FIELD

The present disclosure relates to a sole for a shoe, in particular for a sports shoe, such as a running shoe. The present disclosure also relates to a shoe, in particular a sports shoe, such as a running shoe, comprising such a sole.

BACKGROUND

Soles for shoes, in particular soles for sports shoes, such as running shoes are generally known and have various purposes and use cases.

A shoe sole typically serves a number of different functions, such as diminishing or cushioning of the impact forces occurring upon foot strike and providing traction to avoid slipping of the wearer's foot. In addition, a shoe sole typically serves the function to provide a degree of stability to the wearer's foot, so that the danger of twisting one's ankle or other kinds of injuries, for example injury to the plantar fascia or muscle overloading, etc., can be reduced. Yet a further function of a shoe sole, particularly for performance footwear like running shoes, is to facilitate a good transmission of forces from the athlete's legs through their feet to the ground and an efficient running style, in order to improve the athlete's performance.

Some of many particularly relevant needs in this context is the provision of a sole for a shoe that enables a safer running, supports the wearer during longer distances, reveals a high degree of cushioning, provides a large energy return to the wearer, and that is light weight.

Against this background, it is an object of embodiments of the present disclosure to provide an improved sole for a shoe that overcomes the deficiencies of the prior art at least partially. In particular, it is an object to provide a sole that enhances performance properties, such as the energy return to the wearer without comprising other properties, such as providing sufficient cushioning. It is a general objective to reduce the costs in providing such a sole for a shoe and to provide a lightweight sole.

BRIEF SUMMARY

The above-mentioned objects are at least partially achieved by the subject-matter of the following embodiments. Other suitable features of the present disclosure capable of achieving the above-mentioned objects are described throughout the disclosure.

A first embodiment (1) of the present disclosure is directed to a sole for a shoe, the sole comprising a midsole; and a reinforcing frame, wherein at least a first part of the reinforcing frame substantially surrounds an outer boundary of the midsole in one or more of: a lateral side region, a medial side region, a heel region, and a toe region of the midsole thereby defining an open space, and wherein a part of the midsole is received in the open space.

In a second embodiment (2), a part of the outer boundary of the midsole that is substantially surrounded by the reinforcing frame according to the first embodiment (1) faces a lateral side of the sole and/or a medial side of the sole.

In a third embodiment (3), the open space according to the first embodiment (1) or the second embodiment (2) is arranged substantially in a plane defined by a heel to toe axis and a medial to lateral axis of the sole.

In a fourth embodiment (4), the midsole according to any one of embodiments (1)-(3) comprises an upper midsole layer and a lower midsole layer, and the reinforcing frame is sandwiched between the upper midsole layer and the lower midsole layer.

In a fifth embodiment (5), the upper midsole layer according to the fourth embodiment (4) defines the outer boundary that is substantially surrounded by the reinforcing frame, and the upper midsole layer and the lower midsole layer according to the fourth embodiment (4) are engaged with one another via a form-fit connection, thereby defining the outer boundary.

In a sixth embodiment (6), the upper midsole layer according to the fourth embodiment (4) or the fifth embodiment (5) is received at least partially in an opening formed by the lower midsole layer.

In a seventh embodiment (7), the lower midsole layer according to any one of embodiments (4)-(6) has a cut-out arranged such that the reinforcing frame is at least partially visible from below the lower midsole layer. In some embodiments, the cut-out has an elongated shape aligned along the heel to toe axis of the sole.

In an eighth embodiment (8), the midsole according to any one of embodiments (1)-(7) comprises a polymer foam material.

In a ninth embodiment (9), the open space according to any one of embodiments (1)-(8) is arranged in at least one of: the heel region, a midfoot region, and the toe region of the sole.

In a tenth embodiment (10), the open space according to any one of embodiments (1)-(9) spans at least 10%, at least 20%, at least 30%, at least 40%, at least 50%, at least 60%, at least 70%, or at least 80% of an underfoot area of the sole, and/or at most 99%, at most 95%, or at most 90% of the underfoot area of the sole.

In an eleventh embodiment (11), the reinforcing frame according to any one of embodiments (1)-(10) comprises an arm that comprises a flattened profile in a cross-sectional cut perpendicular to a longitudinal axis of the arm.

In a twelfth embodiment (12), the flattened profile according to the eleventh embodiment (11) has a width substantially in a plane defined by a heel to toe axis and a medial to lateral axis of the sole of at least 3 mm, at least 5 mm, at least 8 mm, at least 10 mm, at least 12 mm, at least 15 mm, or at least 20 mm, and/or of at most 70 mm, at most 60 mm, at most 50 mm, at most 45 mm, at most 40 mm, at most 35 mm, at most 30 mm, or at most 25 mm.

In a thirteenth embodiment (13), the flattened profile according to the eleventh embodiment (11) or the twelfth embodiment (12) has a thickness substantially perpendicular to a plane defined by a heel to toe axis and a medial to lateral axis of the sole of at least 0.2 mm, at least 0.5 mm, at least 0.8 mm, at least 1.0 mm, at least 1.2 mm, or at least 1.5 mm, and/or of at most 3 mm, at most 2.5 mm, at most 2.0 mm, at most 1.8 mm, or at most 1.5 mm.

In a fourteenth embodiment (14), the reinforcing frame according to any one of embodiments (1)-(13) has substantially a uniform thickness.

In a fifteenth embodiment (15), the reinforcing frame according to any one of embodiments (1)-(14) is formed so as to define a three-dimensional shape, such that the reinforcing frame is arranged in at least two substantially parallel planes defined by a heel to toe axis and a medial to lateral axis of the sole, the two planes being spaced apart by at least 1 cm, at least 1.5 cm, at least 2 cm, at least 2.5 cm, at least 3 cm, at least 3.5 cm, or at least 3.6 cm, and/or by at most 5 cm, at most 4.5 cm, at most 4.2 cm, or at most 4.0 cm.

In a sixteenth embodiment (16), a heel segment of the reinforcing frame according to any one of embodiments (1)-(15) extends by a greater amount in an upward direction compared to any other segment of the reinforcing frame.

In a seventeenth embodiment (17), the reinforcing frame according to any one of embodiments (1)-(16) comprises an open frame structure having a first end and a second end, wherein the first end and the second end are spaced apart from each other.

In an eighteenth embodiment (18), the first end and the second end according to the seventeenth embodiment (17) are spaced apart from each other by at least 10% of the length of the sole, at least 20%, at least 30%, at least 40%, or at least 50% of the length of the sole, and/or of at most 80%, at most 70%, at most 60%, or at most 50% of the length of the sole.

In a nineteenth embodiment (19), the first end according to the seventeenth embodiment (17) or the eighteenth embodiment (18) is arranged in a toe region of the sole. In some embodiments, the first end is arranged in a little toe region of the sole.

In a twentieth embodiment (20), the second end according to any one of embodiments (17)-(19) is arranged in a midfoot region of the sole.

In a twenty-first embodiment (21), the reinforcing frame according to any one of embodiments (17)-(20) has the following segments in the following order from the first end to the second end: a substantially straight lateral segment, a curved heel segment, a substantially straight medial segment, a curved toe segment, and a substantially straight midfoot segment. In some embodiments, the first part of the reinforcing frame comprises one or more of the substantially straight lateral segment, the curved heel segment, the substantially straight medial segment, and the curved toe segment.

In a twenty-second embodiment (22), in the sole according to the twenty-first embodiment (21), a width of the midfoot segment, in particular the width (w_se) of the second end, is greater than any other width (w_ts, w_ls) of the reinforcing frame, the width (w_se, w_ts, w_ls) being substantially in a plane defined by a heel to toe axis and a medial to lateral axis of the sole.

In a twenty-third embodiment (23), in the sole according to the twenty-first embodiment (21) or the twenty-second embodiment (22), a width (w_se, w_ts, w_ls) of the reinforcing frame decreases from the second end along the midfoot segment towards the toe segment, the width being substantially in a plane defined by a heel to toe axis and a medial to lateral axis of the sole.

In a twenty-fourth embodiment (24), the midfoot segment according to any one of embodiments (21)-(23), in particular the second end, extends by a greater amount in a downward direction compared to any other segment of the reinforcing frame.

In a twenty-fifth embodiment (25), the sole according to any one of embodiments (1)-(3) or (5)-(24), in combination with the fourth embodiment (4), comprises an outsole arranged below the lower midsole layer.

In a twenty-sixth embodiment (26), the outsole according to the twenty-fifth embodiment (25) has a cut-out arranged such that the reinforcing frame is at least partially visible from below the outsole. In some embodiments, the cut-out has an elongated shape aligned along the heel to toe axis of the sole.

In a twenty-seventh embodiment (27), the cut-out according to the twenty-sixth embodiment (26) is arranged such that the midfoot segment of the reinforcing frame is at least partially visible from below the outsole.

In a twenty-eighth embodiment (28), the reinforcing frame according to any one of embodiments (1)-(27) is at least partially visible from outside the shoe.

In a twenty-ninth embodiment (29), the reinforcing frame according to any one of embodiments (1)-(28) is visible from a medial side, a heel side and/or a lateral side of the sole.

In a thirtieth embodiment (30), in the sole according to any one of embodiments (1)-(3) or (5)-(29), in combination with the fourth embodiment (4), the upper midsole layer comprises a first material and the lower midsole layer comprises a second material. In some embodiments, the first material has a lower stiffness compared to the second material.

In a thirty-first embodiment (31), the reinforcing frame according to any one of embodiments (1)-(30) comprises or consists of one or more of the following materials: thermoplastic polyurethane, polyamide, in particular nylon polyamide, carbon fibers, a carbon fiber composite material, a glass fiber composite material, or ethylene vinyl acetate.

In a thirty-second embodiment (32), the midsole according to any one of embodiments (1)-(31) comprises or consists of a particle foam material, in particular a particle foam material comprising one or more of the following materials: expanded thermoplastic polyurethane, expanded polyamide, expanded polyether-block-amide, expanded polylactide, expanded polyethylene terephthalate, ex-panded polybutylene terephthalate, or expanded thermoplastic polyester ether elastomer.

In a thirty-third embodiment (33), the midsole according to any one of embodiments (1)-(32) comprises or consists of a homogeneous foam material.

In a thirty-fourth embodiment (34), the reinforcing frame according to any one of embodiments (1)-(33) comprises a second part not surrounding the outer boundary of the midsole.

In a thirty-fifth embodiment (35), in the sole according to the thirty-fourth embodiment (34) in combination with the twenty-first embodiment (21), the second part comprises the substantially straight midfoot segment of the reinforcing frame.

A thirty-sixth embodiment (36) of the present disclosure is directed to a shoe, in particular a sports shoe, such as a running shoe, comprising a sole according to any one of embodiments (1)-(35); and an upper attached to the sole.

BRIEF DESCRIPTION OF THE FIGURES

The accompanying figures, which are incorporated herein, form part of the specification and illustrate embodiments of the present disclosure. Together with the description, the figures further serve to explain the principles of and to enable a person skilled in the relevant art(s) to make and use the disclosed embodiments. These figures are intended to be illustrative, not limiting. Although the disclosure is generally described in the con-text of these embodiments, it should be understood that it is not intended to limit the scope of the disclosure to these particular embodiments. In the drawings, like reference numbers indicate identical or functionally similar elements.

DETAILED DESCRIPTION

Figure 1:
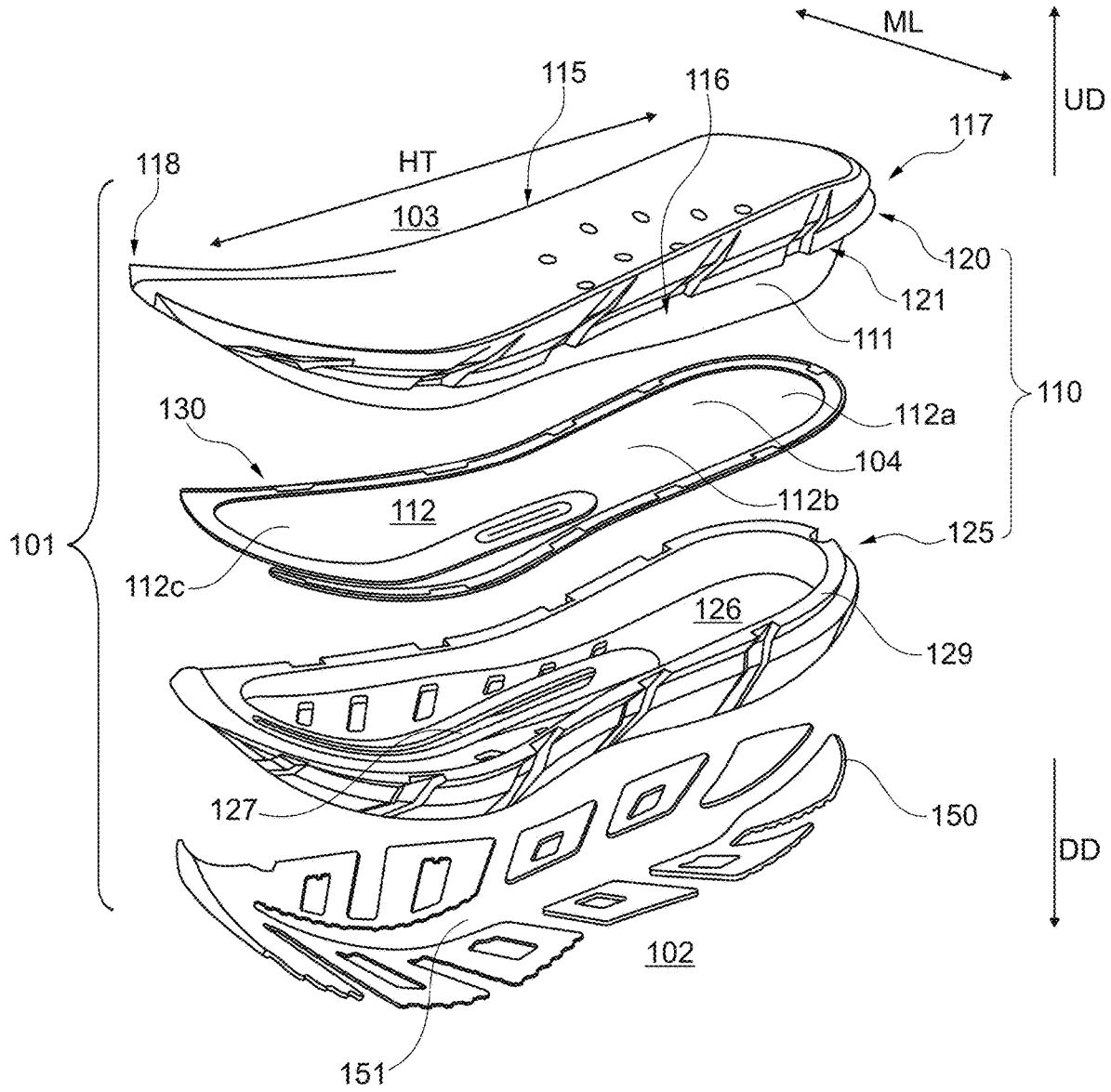
FIG. 1 shows a sole for a shoe, in particular for a sports shoe, according to some embodiments in an exploded view.

In the following only some possible embodiments of the disclosure are described in detail. However, the present disclosure is not limited to these, and a multitude of other embodiments are applicable without departing from the scope of the disclosure. The presented embodiments can be modified in a number of ways and combined with each other whenever compatible and certain features may be omitted in so far as they appear dispensable. In particular, the disclosed embodiments may be modified by combining certain features of one embodiment with one or more features of another embodiment.

It is to be understood that not all features of the described embodiments have to be present for realizing the technical advantages provided by the present disclosure. The disclosed embodiments may be modified by combining certain features of one embodiment with one or more features of another embodiment. Specifically, the skilled person will understand that features, and/or functional elements of one embodiment can be combined with technically compatible features, and/or functional elements of any other embodiment of the present disclosure given that the resulting combination falls within the definition of the present disclosure.

While the embodiments below are described primarily with reference to a sole for a shoe, in particular for a sports shoe, the skilled person will recognize that the disclosure can equally be applied in a plurality of different technical fields and/or use cases.

Throughout the present figures and specification, the same reference numerals refer to the same elements. For the sake of clarity and conciseness, certain aspects of components or steps of certain embodiments are presented without undue detail where such detail would be apparent to those skilled in the art in light of the teachings herein and/or where such detail would obfuscate an understanding of more pertinent aspects of the embodiments.

As understood by the skilled person and/or in order to avoid redundancies, reference is also made to the explanations in the preceding sections, which also apply to the following detailed description.

Where a range of numerical values comprising upper and lower values is recited herein, unless otherwise stated in specific circumstances, the range is intended to include the endpoints thereof, and all integers and fractions within the range. It is not intended that the disclosure or claims be limited to the specific values recited when defining a range. Further, when an amount, concentration, or other value or parameter is given as a range, one or more ranges, or as list of upper values and lower values, this is to be understood as specifically disclosing all ranges formed from any pair of any upper range limit or value and any lower range limit or value, regardless of whether such pairs are separately disclosed.

Definitions

The term "medial", "medial side", "medial side region", and/or "medial side portion" of a sole/midsole as used herein may refer to an inner side and/or inner edge of the sole/midsole. This side and/or edge may be closest to a centerline of the body of the wearer, when the shoe comprising the sole is worn. This side and/or edge may extend from a big toe portion to a heel region. The term "medial side portion" may additionally comprise a small region extending from the medial side towards a heel to toe midline of the sole. The "medial side" and/or "medial side portion" is usually positioned facing the arch of the foot and/or the big toe.

The term "lateral", "lateral side", "lateral side region", and/or "lateral side portion" of a sole/midsole as used herein may refer to an outer side and/or outer edge of the sole/midsole. This side and/or edge may be farther way from a centerline of the body of the wearer, when the shoe comprising the sole is worn. This side and/or edge may extend from a small toe portion to a heel region. The term "lateral side portion" may additionally comprise a small region extending from the lateral side towards a heel to toe midline of the sole.

The term "heel portion" and/or "heel region" of a sole/midsole as used herein may refer to the back part of the sole/midsole, e.g., the rear part of the sole, which usually provides support and cushioning to the heel of the foot of the wearer, when worn. In said heel portion and/or heel region of the sole, an anterior end of a foot of the wearer may be received. In particular, the "calcaneal region" of a foot of a wearer may be received. The calcaneus is a large bone that makes up the heel of the foot.

The term "toe portion" and/or "toe region" of a sole/midsole as used herein may refer to the front part of the sole/midsole, e.g., the forefoot part of the sole/midsole, in which toes of the foot of the wearer can be received, when worn. The toes of the foot of the wearer may include the big toe, and/or of the big toe knuckle. It may include an anterior end of the foot, when worn. Further, the toe portion and/or the toe region may include distal phalanges, intermedial phalanges and proximal phalanges of a foot of a wearer, when worn. The toe portion and/or the toe region may additionally include a frontal part of the metatarsal bones of a foot of a wearer, when worn.

The term "forefoot" of the sole as used herein may refer to the front portion of the outsole. The forefoot portion of the outsole shoe may cover an area of the foot corresponding to the toes and a base of the toes. In one example, the forefoot may cover less than about half of the front of the underfoot portion or less than about one third of the front of the underfoot.

The term "underfoot area" of the sole as used herein may be determined for instance in a plane defined by a heel to toe axis and a medial to lateral axis of sole. In other words, the underfoot area of the sole may be measured substantially in a horizontal plane, perpendicular to a vertical axis. The underfoot area of the sole may be the area with which the bottom of a foot of a wearer would come into contact (disregarding the presence of an upper and/or an insole), when a shoe comprising such a sole is worn.

The term "upward direction" as used herein may be the direction from an underfoot portion of the upper to an upper portion of the upper. For instance, the upward direction may be the direction from the underfoot portion of the upper to an instep portion of the upper. The upward direction may be substantially parallel to a vertical axis.

The term "downward direction" as used herein may be directed substantially opposite to the upward direction.

The term "vertical axis" as used herein may substantially correspond to the wearer's main body axis from head to foot when the wearer stands on the ground.

Unless otherwise stated, the term "substantial" or "substantially" as used in the present context may be understood to a great or significant extent or for the most part. In particular, minor tolerances such as manufacturing tolerances and/or variations are to be included by this term. Hence, any values or arrangements described by using this term may slightly deviate from the described values or arrangements.

Unless specified otherwise, when referring to a direction or dimension, the term "about," "substantial" or "substantially" means a first direction or dimension is +/−10% of a second direction or dimension.

The term "and/or" is only an association relationship describing associated objects and represents that three relationships may exist. For example, A and/or B may represent three conditions: i.e., independent existence of A, existence of both A and B and independent existence of B. In addition, the character "/" in the disclosure usually represents that previous and next associated objects form an "or" relationship. As a further example, in case it is mentioned in here that at least a first part of the reinforcing frame substantially surrounds an outer boundary of the midsole in a lateral side region, a medial side region, a heel region, and/or a toe region of the midsole, this means that the lateral side region, the medial side region, the heel region and the toe region are all each connected with the association "and/or". Alternatively, this phrase may mean that at least a first part of the reinforcing frame substantially surrounds an outer boundary of the midsole in one or more of: a lateral side region, a medial side region, a heel region, and a toe region of the midsole.

The term "comprising" is an open-ended transitional phrase. A list of elements following the transitional phrase "comprising" is a non-exclusive list, such that elements in addition to those specifically recited in the list can also be present. The phrase "consisting essentially of" limits the composition of a component to the specified materials and those that do not materially affect the basic and novel characteristic(s) of the component. The phrase "consisting of" limits the composition of a component to the specified materials and excludes any material not specified.

The terms "bottom", "top", "one end", "the other end", "outer side", "upper", "above", "inner side", "under", "below", "horizontal", "coaxial", "central", "end" "part", "length", "outer end" etc., which indicate the orientation or positional relationship, are based on the orientation or positional relationship shown in the drawings.

The terms "upper", "above", "below", "under" and the like as used in the present disclosure to indicate a relative position in space are used for the purpose of facilitating explanation to describe a sole for a shoe, an element, a part, an object and/or a feature shown in the drawings relative to the relationship of another sole for a shoe, element, part, object and/or feature.

It is noted that the headlines in the present disclosure are provided solely for the purpose to assist in keeping an overview during reading. The headlines do not mean that features of the respective embodiments cannot be combined.

Sole for a Shoe

The above-mentioned objects are solved by a sole for a shoe, in particular for a sports shoe, such as a running shoe, the sole comprising: a midsole; and a reinforcing frame, wherein at least a first part of the reinforcing frame substantially surrounds an outer boundary of the midsole in one or more of: a lateral side region, a medial side region, a heel region, and a toe region of the midsole thereby defining an open space, wherein a part of the midsole is received in the open space.

In this manner, the sole for a shoe, in particular for a sports shoe, provides for an improved stability, comfort, and energy return to the wearer. Overall, enhanced performance properties can thereby be provided. This makes the sole particularly useful for athletic activities. Thereby, the sole may provide significant advances when used in running shoes, in particular for long-distance running shoes. However, people wearing such shoes during occasions other than running may benefit from these advantages. The sole according to the present disclosure has the further advantage that it is rather light weight, that it enables a safer running, and that the midsole can provide beneficial cushioning effects, for example when provided with a foam as described elsewhere herein.

In most prior art solutions, rather stiff reinforcing elements are provided that cover a large bottom part of the midsole, e.g., the underfoot portion of the midsole or also referred to as the footbed of the midsole. Without wishing to be bound by theory, it is believed that this may be detrimental as a quite rigid feeling is provided to the wearer at the underfoot. In addition, this may adversely affect cushioning of the underfoot of the wearer. According to the sole as proposed in here, these disadvantages of the prior art can be overcome, whilst still providing sufficient stability to the wearer.

A further advantage attributable to the fact that the reinforcing frame has the shape of a frame and that it surrounds an outer boundary of the midsole, is that the reinforcing frame is provided at dedicated locations where it is needed the most and left out at locations, where it is detrimental for the desired cushioning effect. It is appreciated that due to the reinforcing frame surrounding the outer boundary of the midsole in one or more of a lateral side region, a medial side region, a heel region, and a toe region of the midsole, a major underfoot area of the foot may be left open and may define the open space. Thereby, a cushioning effect of the midsole may be enhanced, as it is not particularly impaired by the reinforcing frame interfering in a portion where cushioning is desired. For instance, the reinforcing frame may not substantially impede the midsole, may not block the midsole, and/or may not interfere with the midsole in regions of the foot where cushioning is desired, e.g., in the underfoot portion.

In this manner, the sole according to the present disclosure can guide the impact forces of the wearer without adversely impacting underfoot cushioning. In particular, when considering a typical gait cycle of an athlete during running, the sole starts acting at the loading phase and allows for a dynamic stiffening of the midsole attributable to the reinforcing frame, as the athlete moves toward the big toe and into push off, e.g., toe off.

The term "midsole" as used in the present disclosure may be referred to as a layer of material that may be located between an outsole of a shoe, e.g., the bottom part of the sole that makes contact with the ground, and an upper of a shoe, e.g., the part of the shoe that covers the top of a foot of a wearer.

The term "reinforcing frame" as used in the present disclosure may be referred to as a structural element that can provide for the function of reinforcing. Said structural element has the shape of a frame. Although possible, the reinforcing frame may not necessarily form a closed loop or closed frame. For instance, the reinforcing frame may have two distinct ends. For instance, the frame could be regarded as a paper clip or the like, which is an open frame. The reinforcing frame may be understood such that it frames, e.g., encloses something.

The "outer boundary" of the midsole as used in the present disclosure may be referred to as a boundary, which is facing the outside of the midsole. For instance, the outer boundary of the midsole may be an outermost portion of the midsole. As an illustrative example, an inner boundary would be a boundary that is directed to a central portion of the midsole. Thereby, the inner boundary could be regarded to be opposite to the outer boundary. The outer boundary of the midsole may be one or more of a surface, an edge, a line, a perimeter, or the like of the midsole. As derivable from the term "boundary", the "outer boundary" may indicate a limit or the like. For instance, the outer boundary may be free to the environment or the like. The outer boundary of the midsole may provide a recognizable demarcation between the midsole and other parts of the shoe and/or between the midsole and the environment. Thereby, beyond said outer boundary of the midsole in the direction to the outside, the midsole may not be present. Nevertheless, it could well be the case that the midsole is formed such that portions of the midsole protrude to a greater extent to the outside than the "outer boundary" of the midsole. Although such portions can also be referred to as having an outer boundary of the midsole, the "outer boundary" of the midsole that protrudes to a smaller extent to the outside may still be regarded as an outer boundary of the midsole.

It is noted that although at least a first part of the reinforcing frame substantially surrounds an outer boundary of the midsole in one or more of a lateral side region, a medial side region, a heel region, and a toe region, this does not mean that all of the reinforcing frame necessarily surrounds an outer boundary of the midsole—this may or may not be the case. It is encompassed in the present disclosure that a second part of the reinforcing frame, that is different from the first part, does not surround an outer boundary of the midsole. For instance, the reinforcing frame may comprise a second part, such as a substantially straight midfoot segment described elsewhere herein, which may not surround an outer boundary of the midsole in one or more of a lateral side region, a medial side region, a heel region and or a toe region of the midsole. Of course, it is encompassed in the present disclosure that the reinforcing frame comprises further parts that may or may not surround an outer boundary of the midsole. Moreover, the first part of the reinforcing frame, the second part of the reinforcing frame, and/or any further part of the reinforcing may be integrally formed as one piece. Alternatively, they may be formed as separate pieces and may be connected to each other.

As described elsewhere herein, the first part of the reinforcing frame that substantially surrounds an outer boundary of the midsole in one or more of a lateral side region, a medial side region, a heel region and or a toe region of the midsole may be for instance one or more of: the substantially straight lateral segment, the curved heel segment, the substantially straight medial segment, and the curved toe segment.

As understood by the skilled person, since at least a first part of the reinforcing frame substantially "surrounds an outer boundary" of the midsole, the outer boundary of the midsole may not be fully exposed to the environment, as it may be covered at least partially by the reinforcing frame. Further, the outer boundary of the midsole may not be fully visible from the outside due to the reinforcing frame. In one example, the term "surround" means to enclose something on all sides. In one example, the term "surround" means to extend around a margin or edge of something.

The reinforcing frame substantially surrounds an outer boundary of the midsole in one or more of "a lateral side region, a medial side region, a heel region, and a toe region of the midsole", which may be understood such that these regions are substantially wrapped, enclosed or the like by the reinforcing frame. In other words, the reinforcing frame may substantially be arranged around these regions of the midsole, which are described in greater detail elsewhere herein. As implied by the term "surround", it may not be sufficient that the reinforcing frame forms a flat shape in one plane, such as a horizontal plane that merely lies on a flat plane of the midsole, such as a flat heel region of the midsole. In such a scenario, the flat heel region of the midsole may not be regarded as being surrounded by the reinforcing frame. However, the term "surround" does not preclude any "sandwich"-type arrangements as described herein. The term "substantially" surrounds an outer boundary may mean that the reinforcing frame surrounds an outer boundary of the midsole by at least 60%, at least 70%, at least 80%, or by at least 90% of the outer boundary.

The term "open space" as used in the present disclosure may be referred to as a three-dimensional volume. Further, a part of the midsole is received in the open space. This may mean that the open space is not empty. Further, it is not precluded that the open space may be filled at least partially with one or more additional parts, components, elements, or the like. However, the open space may not be filled with the reinforcing frame, as understood by the skilled person. Otherwise, the reinforcing frame could not define an open space. As understood by the skilled person, the open space may be a macroscopic space, i.e., a space that could be easily recognized as such a space by the skilled person.

The "lateral side region", and/or the "medial side region" of the midsole may refer to a side and/or edge of the midsole that extends from a heel region to at least a metatarsal region. For instance, the "lateral side region", and/or the "medial side region" of the midsole may extend from a heel region to a small toe portion.

The sole for a shoe described herein may be useful in conjunction with and/or when applied to a sports shoe, such as a running shoe, in particular a long-distance running shoe, or the like. However, it should be noted that the sole could be used with any kind of article of footwear including, but not limited to football shoes, hiking boots, sneakers, basketball shoes, rugby shoes, baseball shoes, golf shoes, tennis shoes, cross-training shoes. Moreover, the sole may be used in conjunction with shoes for any kind of athletic activity.

The term "athletic activity" is to be understood such that it includes one or more and/or any combination of at least the following non-exhaustive list: aerobics, athletic exercises, running, hiking, climbing, group fitness classes, walking, cycling, yoga, soccer, tennis, football, basketball, doing a workout, volleyball, gymnastics, weightlifting, cross-training, baseball, softball, rugby, field hockey, wrestling, squash, track and field (such as sprinting, long jump, high jump), cross-country skiing.

Further, it may be possible that the reinforcing frame providing for the added benefits described herein are additionally or alternatively used for garments, and/or equipment used in athletic activities. That is, the reinforcing frame is not necessarily limited to the example of a sole for a shoe. It could be feasible that the concept of the reinforcing frame is transferred to any kind of activity or athletic activity in which stability, comfort, or generally any support to the wearer is required.

Nevertheless, it was found that the advantages of the reinforcing frame described herein are particularly pronounced when applied to a sole for a shoe, such as a shoe used during an athletic activity.

The "wearer" referred to herein may be a human capable of wearing an article of footwear. The term "wearer" may be used synonymously to the terms "user", "athlete", "human being" or the like.

Surrounding

In some embodiments of the sole for a shoe as described herein, a part of the outer boundary of the midsole that is substantially surrounded by the reinforcing frame faces a lateral side of the sole and/or a medial side of the sole.

This may be understood in such a manner that the reinforcing frame surrounds an outer boundary that may face a side, e.g., may face a horizontal direction as opposed to a vertical direction.

This has the advantage that the mechanical support and/or stability of the midsole may be improved, as the reinforcing frame may act as a shield, substantially supporting the midsole from the outside to the inside. The arrangement may also be regarded as self-supporting, due to the presence of the reinforcing frame at the outside.

In some embodiments of the sole for a shoe as described herein, the open space is arranged substantially in a plane defined by a heel to toe axis and a medial to lateral axis of the sole.

This has the advantage that the open space is provided substantially in a horizontal plane, in which cushioning for a wearer may be more important as opposed to a plane arranged along a vertical axis. In particular, as the open space is substantially free from the reinforcing frame, it may not interfere with the midsole in this horizontal plane, where a foot of the wearer should be cushioned.

Sandwiched Structure and Form-Fitting of Midsole

In some embodiments of the sole for a shoe as described herein, the midsole comprises an upper midsole layer and a lower midsole layer, wherein the reinforcing frame is sandwiched between the upper midsole layer and the lower midsole layer.

This has the advantage that different materials may be provided in the upper midsole layer and the lower midsole layer in some embodiments. For instance, a stiffness of a material of the upper midsole layer may be different than a material of the lower midsole layer. This has the added benefit to provide for specific functions to these layers.

In addition, the reinforcing frame being sandwiched between the upper midsole layer and the lower midsole layer may provide for additional support to the reinforcing frame between the upper midsole layer and the lower midsole layer. For instance, already gravitational forces may substantially maintain the reinforcing frame in its position such that it does not substantially change its position upon a pressure load.

As understood by the skilled person, the upper midsole layer may be arranged in an upward direction (e.g., along the vertical axis from the ground to the heaven as seen during ordinary use of the shoe) with respect to the reinforcing frame. Further, the lower midsole layer may be arranged in a downward direction (e.g., along the vertical axis from the heaven to the ground as seen during ordinary use of the shoe) with respect to the reinforcing frame.

It may alternatively be possible in the light of the present disclosure that the upper midsole layer and the lower midsole layer are formed as one unitary piece. In such an alternative, the upper midsole layer and the lower midsole layer may not be separate but may form one midsole.

In some embodiments of the sole for a shoe as described herein, the reinforcing frame lays substantially flat between surfaces of the upper midsole layer and the lower midsole layer, in a sandwich-like arrangement.

In some embodiments of the sole for a shoe as described herein, the upper midsole layer and the lower midsole layer are engaged with one another via a form-fit connection, thereby defining the outer boundary of the upper midsole layer that is substantially surrounded by the reinforcing frame.

To be engaged may be understood as to be accommodated and/or to be received.

This has the advantage that the upper midsole layer and the lower midsole layer may be easily assembled and may provide for a firm construction. Although possible, said firm construction may not necessarily need any separate means for attachment such as adhesives or the like. The arrangement may therefore be regarded as being at least partially self-supporting.

The form-fit connection may be understood such that the upper midsole layer and the lower midsole layer may be shaped or designed to fit into one another. Further, the reinforcing frame may be shaped or designed to fit in between surfaces formed by the upper midsole layer and the lower midsole layer in a sandwich-like arrangement. The various parts participating on said sandwich-like arrangement fit into each other due to their substantially complementary geometry. This may create a tight and secure fit without the need for additional fasteners or adhesives, however the use of additional fasteners or adhesives may not necessarily be precluded. The connection may rely on the geometry of the upper midsole layer and the lower midsole layer to create a strong and stable attachment. It is noted that in various examples, additional fasteners or adhesives may be used, for instance, cement or the like may be used to improve the fit between the upper midsole layer and the lower midsole layer.

In some embodiments, co-molding may be used as an alternative to arranging the upper midsole layer and the lower midsole layer. Co-molding may also be referred to as overmolding or two-shot molding. Co-molding may be a manufacturing process to create a part or product made from two or more different materials. This process may involve injecting two or more materials into a mold in a sequential manner to produce a single, integrated component with distinct layers or sections. The materials used in co-molding can vary in terms of color, texture, hardness, and even chemical properties.

The outer boundary of the midsole, which is substantially surrounded by the reinforcing frame, may be defined by such an engagement and form-fit connection. This has the advantage that the outer boundary of the midsole so defined, may be covered by the reinforcing frame. This bears the potential that a smooth overall outer boundary of the sole may be established.

In some embodiments, the reinforcing frame may at least partially fill out a gap provided between the upper midsole layer and the lower midsole layer as seen along the vertical axis.

In some embodiments of the sole for a shoe as described herein, the upper midsole layer is received at least partially in an opening formed by the lower midsole layer.

This further contributes to a tight and secure fit without the need for additional fasteners or adhesives. However, the use of additional fasteners or adhesives may not necessarily be precluded merely by the formfitting arrangement.

Such embodiments may be understood such that the upper midsole layer may comprise an extension, protrusion, projection, or the like. This is received at least partially in the opening formed by the lower midsole layer or more generally in a recess formed by the lower midsole layer. Thereby, an outer surface of the extension, protrusion, projection, or the like of the upper midsole layer may contact at least partially an inner surface of the recess of the lower midsole layer.

The opening formed by the lower midsole layer may substantially correspond to an underfoot portion of the midsole. In particular, the opening may substantially correspond to the size of the open space as seen in a horizontal plane.

In some embodiments of the sole for a shoe as described herein, the lower midsole layer has a cut-out, arranged such that the reinforcing frame is at least partially visible from below the lower midsole layer. In some embodiments, the cut-out has an elongated shape aligned along the heel to toe axis of the sole.

This has the advantage that a state of the reinforcing frame, such as its solidity, firmness, or the like may be assessed by a person.

This may have the further advantage that the outer appearance of the sole and/or the shoe could be adjusted so as to indicate the wearer that the reinforcing frame that is visible may be equipped with a certain functionality. Thereby, this could influence adaptation of the wearer's performance accordingly. Further, such a visibility may influence the wearer's performance, confidence, and/or motivation in engaging in an athletic activity in the first instance.

The reinforcing frame being at least partially visible from below the lower midsole layer may be understood such that during ordinary use of the sole, a human may recognize the reinforcing frame from below the lower midsole layer. It is well encompassed in the present disclosure that a part of the reinforcing frame is not visible from below the lower midsole layer.

The cut-out may be understood as a through hole, an aperture, a recess, or the like. The cut-out may be implemented by one or more of a groove, a slit, a cut, and/or a vent or the like. For example, the cut-out may form a space that is free from the material of the lower midsole layer.

The term "elongated" means that there may be a dimension along one axis of the cut-out, which may be larger than one, and preferably, than both dimensions along the remaining axes, the remaining axes being substantially perpendicular to said one axis. It is understood that when dimensions are described herein, manufacturing tolerances usually have to be taken into consideration. Thus, the dimensions described herein may vary slightly.

The elongated shape of the cut-out aligned along the heel to toe axis of the sole may have the advantage that the firmness and/or the stability of the lower midsole layer can be substantially maintained and/or is at least not substantially impaired whilst the reinforcing frame is visible from below the lower midsole layer.

It is well encompassed within the present disclosure that the lower midsole layer may comprise one or more and, in particular, a plurality of cut-outs. Nevertheless, not all cut-outs may necessarily be configured such that the reinforcing frame is at least partially visible from below the lower midsole layer.

In some embodiments of the sole for a shoe as described herein, the cut-out of the lower midsole layer is arranged such that a midfoot segment (as described elsewhere herein in greater detail) of the reinforcing frame is at least partially visible from below the lower midsole layer.

Open Space

In some embodiments of the sole for a shoe as described herein, the midsole comprises a polymer foam material.

This has the advantage that the polymer foam material can provide for the desired cushioning effect. This may be particularly useful in combination with the open space, through which the midsole, in particular the upper midsole layer, may at least partially protrude. In addition, since the open space is substantially free from the reinforcing frame, the midsole, in particular the upper midsole layer may not be hindered from any structural components when being deformed under a pressure load on the sole. This enhances the cushioning effect.

In some embodiments of the sole for a shoe as described herein, the open space is arranged in at least one of: a heel region, a midfoot region, and a toe region of the sole.

This further contributes to the advantages mentioned elsewhere herein in the context of cushioning whilst providing sufficient energy return. In particular, the open space according to this embodiment may encompass rather large regions of the underfoot of the sole. In turn, in these rather large regions the reinforcing frame does not substantially impede the midsole, block the midsole, and/or interfere with the midsole. Accordingly, the midsole can properly provide for the cushioning effect.

In some embodiments of the sole for a shoe as described herein, the open space spans at least 10%, at least 20%, at least 30%, at least 40%, at least 50%, at least 60%, at least 70%, or at least 80% of an underfoot area of the sole, and/or at most 99%, at most 95%, or at most 90% of the underfoot area of the sole. The open space may be a three-dimensional space. As the skilled person will understand, the term "spans" may mean in this context that a two-dimensional projection of the three-dimensional open space onto the two-dimensional underfoot area spans the indicated percentage fractions of the underfoot area.

This further contributes to the advantages mentioned elsewhere herein in the context of cushioning whilst providing sufficient energy return.

The open space should not span an underfoot area of the sole to such an extent that the stability of the sole may be adversely affected. Therefore, an upper limit for said spanning should be provided. Nevertheless, the open space should span an underfoot area at least to such an extent that the advantages of the open space, e.g., to provide for a rather large area in which deformation of the midsole is not blocked and/or not impaired by any structural components, such as the reinforcing frame, become apparent. In addition, spanning an underfoot area of the sole to a greater extent due to the open space may bear the potential to reduce material consumption.

Thus, without wishing to be bound by theory, it is believed that an optimal balance between these conflicting requirements can be struck according to the values as specified in here.

Arm of the Reinforcing Frame

In some embodiments of the sole for a shoe as described herein, the reinforcing frame comprises an arm, which comprises a flattened profile in a cross-sectional cut perpendicular to a longitudinal axis of the arm. The flattened profile may have a substantially rectangular cross-section.

The flattened profile has the advantage of providing a reinforcing frame with minimal volume and/or minimal physical presence, whilst the advantages thereof in terms of enhanced energy return can be provided. In addition, the flattened profile reduces material consumption.

The arm may be understood as a structural element that substantially forms the reinforcement frame. The "arm" may additionally or alternatively be referred to as a leg, or the like.

The longitudinal axis of the arm may be readily recognized as the axis that substantially follows the extension of the greatest dimension of the arm.

In some embodiments of the sole for a shoe as described herein, the flattened profile has a width approximately in a plane defined by a heel to toe axis and a medial to lateral axis of the sole, of at least 3 mm, at least 5 mm, at least 8 mm, at least 10 mm, at least 12 mm, at least 15 mm, or at least 20 mm, and/or of at most 70 mm, at most 60 mm, at most 50 mm, at most 45 mm, at most 40 mm, at most 35 mm, at most 30 mm, or at most 25 mm.

With the width of the flattened profile as specified in such embodiments, an optimal balance can be struck between two different and conflicting requirements. On the one side, sufficient stiffening, improved reinforcement, and enhanced energy return are desired, for which a greater width would be beneficial. On the other side, it should be ensured that substantially no interference with the midsole occurs to allow for improved cushioning properties and improved assembling capabilities. For this, a smaller width would be beneficial.

In some embodiments of the sole for a shoe as described herein, the flattened profile has a thickness approximately perpendicular to a plane defined by a heel to toe axis and a medial to lateral axis of the sole, of at least 0.2 mm, at least 0.5 mm, at least 0.8 mm, at least 1.0 mm, at least 1.2 mm, or at least 1.5 mm, and/or of at most 3 mm, at most 2.5 mm, at most 2.0 mm, at most 1.8 mm, or at most 1.5 mm.

The thickness of the flattened profile should not be too large as this may require more material and may lead to a bulky construction of the reinforcing frame. A smaller thickness may contribute to a more minimalistic construction of the reinforcing frame. This has the advantage that the reinforcing frame may not act and/or feel like a large foreign part or object. Rather, the reinforcing frame may be smoothly integrated to the sole, which is appreciated by the wearer. Further, material usage can thereby be reduced, which has economic and ecological advantages. Moreover, a reinforcing frame having a smaller thickness and/or width has the further advantage of reducing the weight of the sole, thereby reducing the overall weight of the shoe, which is particularly advantageous when the shoe is used for an athletic activity like running. Therefore, an upper limit to the thickness of the flattened profile should be provided. Nevertheless, the thickness of the flattened profile should have at least a minimum value such that the advantages of the reinforcing frame, e.g., to provide sufficient energy return to a wearer, become apparent. Thus, without wishing to be bound by theory, it is believed that an optimal balance between these conflicting requirements can be struck according to the values as specified in here.

In some embodiments of the sole for a shoe as described herein, the reinforcing frame has substantially a uniform thickness.

As understood by the skilled person, although the reinforcing frame has substantially a uniform thickness, it may still be possible that the reinforcing frame has certain sections in which the thickness is slightly different than in other sections. For instance, manufacturing tolerances may need to be taken into consideration, which could lead to such differences. Further, along the width direction of one section of the reinforcing frame, the thickness may vary, e.g., in the center the thickness may be greater or smaller compared to an outer side of said section. In some embodiments, a surface of the reinforcing frame may be structured, e.g., embossed, such that minor differences in the thickness may be present. Such structures may aid in stock fitting of the reinforcing frame. Further, structures may be provided that provide a design visual, which is thereby engraved.

First End, Second End, Three-Dimensional Shape

In some embodiments of the sole for a shoe as described herein, the reinforcing frame is formed so as to define a three-dimensional shape, such that it is arranged in at least two substantially parallel planes defined by the heel to toe axis and the medial to lateral axis of the sole, the two planes being spaced apart by at least 1 cm, at least 1.5 cm, at least 2 cm, at least 2.5 cm, at least 3 cm, at least 3.5 cm, or at least 3.6 cm, and/or by at most 5 cm, at most 4.5 cm, at most 4.2 cm, or by at most 4.0 cm.

Being spaced apart means that a distance between the at least two planes may be present, the distance being measured substantially perpendicular to the at least two planes. In one example, the distance may be recognizable by the skilled person without any specific equipment.

The three-dimensional shape has the advantage that the reinforcing frame is not only lying in one plane defined by the heel to toe axis and the medial to lateral axis of the sole. Rather, the reinforcing frame can be provided in planes and/or areas of the sole at which such reinforcing is desired and/or where it is most effective. The three-dimensional shape may aid in rebuilding natural shapes, such as anatomical shapes, which could help to arrange the reinforcing frame more precisely at dedicated positions. The three-dimensional shape may also facilitate stock fitting of the reinforcing frame in the sole. For instance, the reinforcing frame may be more easily stock fitted between the upper midsole layer and the lower midsole layer. This provides for synergistic effects of the three components of the sole, i.e., the upper midsole layer, the lower midsole layer, and the reinforcing frame.

In the prior art, a plurality of separate reinforcing parts or elements are usually required to achieve this effect. The unitary reinforcing frames according to embodiments described herein overcome this issue.

The at least two substantially parallel planes being spaced apart may be understood in such a manner that they are spaced apart along a vertical axis.

The reinforcing frame should not be arranged in two planes that are spaced apart to such an extent that arranging the reinforcing frame in the sole is impaired. Therefore, an upper limit should be provided. Nevertheless, the reinforcing frame should be arranged in two planes that are spaced apart at least to a minimum extent such that the advantages of the reinforcing frame, e.g., to provide sufficient energy return to a wearer, become apparent. Thus, without wishing to be bound by theory, it is believed that an optimal balance between these conflicting requirements can be struck according to the values as specified in here.

The plane defined by the heel to toe axis and the medial to lateral axis of the sole may also be referred to as the horizontal plane, e.g., horizontal with respect to a ground when a shoe comprising the sole stands on the ground.

In some embodiments of the sole for a shoe as described herein, a heel segment of the reinforcing frame extends by a greater amount in an upward direction compared to any other segment of the reinforcing frame.

This extension of the heel segment has the advantage of further contributing to an enhanced energy return to the wearer during the gait cycle and in particular during the toe off phase.

Further, as the heel segment may surround the heel portion of the midsole at a higher level as seen along the vertical axis, this may have the additional benefit of stopping shearing forces and/or vibrations. This may also cater to the needs of an athlete being a heel striker, i.e., an athlete that touches the ground with the heel of the shoe first.

In some embodiments of the sole for a shoe as described herein, the reinforcing frame comprises an open frame structure having a first end and a second end, wherein the first end and the second end are spaced apart from each other.

The open frame structure has the advantage of providing a dynamic and active reinforcing frame. Attributable to the open frame structure, i.e., not having a closed frame or not a closed connection of the reinforcing frame, the reinforcing frame allows to guide the foot of the wearer whilst still adapting to the foot of the wearer in terms of torsion ability. This may in particular be the case, as dynamic forces are transferred from a lateral side to a medial side of the foot of the wearer. Such transfer of dynamic forces may be present, for example, during the gait cycle or when the wearer makes turns or the like.

It is noted that an open structure can adapt to such dynamic forces to a greater extent as compared to a closed structure, e.g., a plate or the like, which is commonly applied in the prior art. Such a closed plate, which may in addition only be arranged in one plane parallel to a medial to lateral axis and a heel to toe axis of the sole (and not in a plurality of such planes spaced apart and being parallel to one another) may in addition encompass a great underfoot area of the sole and may impair the wearer. Without wishing to be bound by theory, it is believed that such a closed plate would comparably reduce torsion and adaptability. The open frame structure of the reinforcing frame according to embodiments described herein allows freedom of torsion ability while at the same time the wearer can be propelled into a forward direction due to energy return.

In some embodiments of the sole for a shoe as described herein, the first end and the second end are spaced apart from each other by at least 10% of the length of the sole, at least 20% of the length of the sole, at least 30% of the length of the sole, at least 40% of the length of the sole, or at least 50% of the length of the sole, and/or of at most 80% of the length of the sole, at most 70% of the length of the sole, at most 60% of the length of the sole, or at most 50% of the length of the sole.

Spacing the first end and the second end apart allows more design freedom and facilitates a more dynamic behavior of the reinforcing frame. In particular, the first end and the second end may be arranged at locations where such energy return may be desired the most or at least to a great extent. Nevertheless, the first end and the second end should not be spaced apart by such a great extent that the reinforcing frame itself may lose some of its desired stiffness. Thus, without wishing to be bound by theory, it is believed that an optimal balance between these conflicting requirements can be struck according to the values as specified in here.

It is noted that the length of the sole may generally be measured along the heel to toe axis of the sole.

In some embodiments of the sole for a shoe as described herein, the first end is arranged in a toe region. In some embodiments, the first end is arranged in a little toe region.

This further contributes to the advantages of the reinforcing frame in that it provides enhanced energy return to the wearer. In particular, support to the toe region can thereby be provided, which may be helpful in the toe off phase during the gait cycle.

In some embodiments of the sole for a shoe as described herein, the second end is arranged in a midfoot region of the sole.

This has the advantage that more energy return can be provided to the midfoot region of the sole, and thereby, to the midfoot region of the foot of the wearer. This can be particularly important in the toe off phase.

In some embodiments of the sole for a shoe as described herein, the reinforcing frame has the following segments in the following order from the first end to the second end: a substantially straight lateral segment, a curved heel segment, a substantially straight medial segment, a curved toe segment, and a substantially straight midfoot segment.

This has the advantage that a greater stiffness and a greater reinforcement effect can be ensured at substantially all locations where it is desired.

The midfoot segment may range from a toe portion to a central portion of the midfoot portion. The midfoot segment may have a longitudinal shape. The midfoot segment has the additional benefit that sufficient stiffness for the toe off phase can be provided. This may be particularly beneficial for the end of one's gait cycle at the toe off phase. Further, the stiffening of the midfoot to forefoot portion results in an enhanced energy return for the wearer.

In some embodiments of the sole for a shoe as described herein, a width of the midfoot segment, in particular the width of the second end, is greater than any other width of the reinforcing frame, the width being substantially in a plane defined by a heel to toe axis and a medial to lateral axis of the sole.

The midfoot generally benefits from more support and/or stabilizing and can be an important portion where energy return to the wearer can significantly improve athlete's performance. Therefore, such embodiments have the advantage that a greater width of the frame, i.e., a wider base of the frame can provide for these needs and can help to support the midfoot of a wearer.

In some embodiments of the sole for a shoe as described herein, a width of the reinforcing frame decreases from the second end along the midfoot segment towards the toe segment, the width being substantially in a plane defined by a heel to toe axis and a medial to lateral axis of the sole.

This has the advantage that stock fitting of the reinforcing frame may be enhanced as described elsewhere herein. In addition, it serves the purpose that more foam material may be provided in the midfoot and/or forefoot of the sole, as the width of the reinforcing frame decreases towards the toe segment. This may enhance cushioning properties to the foot of the wearer. This may be particularly helpful in the forefoot of the sole.

In some embodiments of the sole for a shoe as described herein, the midfoot segment, in particular the second end, extends by a greater amount in a downward direction compared to any other segment of the reinforcing frame.

This has the advantage that the midfoot of a foot of a wearer can be supported and/or stabilized to a greater extent. Accordingly, such embodiments further improve the sole and makes it particularly useful in athletic activities.

Outsole

In some embodiments of the sole for a shoe as described herein, the sole comprises an outsole arranged below the lower midsole layer.

The outsole may be the bottom portion of the sole that comes at least partially into direct contact with the ground. This means that not the overall outsole must necessarily contact the ground, although this may often be the case. The outsole may offer several advantages that contribute to the overall performance, comfort, grip, durability, stability, and support, water, and weather resistance of the sole.

Visibility

In some embodiments of the sole for a shoe as described herein, the outsole has a cut-out arranged such that the reinforcing frame is at least partially visible from below the outsole. In some embodiments, the cut-out has an elongated shape aligned along the heel to toe axis of the sole.

This has the advantage that a state of the reinforcing frame, such as its solidity, firmness, or the like may be assessed by a person.

This may have the further advantage that the outer appearance of the sole and/or the shoe could be adjusted so as to indicate the wearer that the reinforcing frame that is visible may be equipped with a certain functionality. Thereby, this could influence adaptation of the wearer's performance accordingly. Further, such a visibility may influence the wearer's performance, confidence, and/or motivation in engaging in an athletic activity in the first instance.

The reinforcing frame being at least partially visible may be understood such that during ordinary use of the sole, a human may recognize the reinforcing frame from below the outsole.

The cut-out of the outsole may be substantially similar or the same as the cut-out of the lower midsole layer described elsewhere herein in greater detail.

The term "elongated" as used in the context of the cut-out of the outsole may be understood in a similar manner as used in the context of the cut-out of the lower midsole layer described elsewhere herein in greater detail.

The elongated shape of the cut-out of the outsole aligned along the heel to toe axis of the sole may have the advantage that the firmness and/or the stability of the outsole can be substantially maintained and/or is at least not substantially impaired whilst the reinforcing frame is visible from below the outsole.

It is well encompassed within the present disclosure that the outsole may comprise one or more and, in particular, a plurality of cut-outs. Nevertheless, not all cut-outs may necessarily be configured such that the reinforcing frame is at least partially visible from below the outsole.

In some embodiments of the sole for a shoe as described herein, the cut-out is arranged such that the midfoot segment of the reinforcing frame is at least partially visible from below the outsole.

This further contributes to the advantages mentioned elsewhere herein in the context of the cut-out. Visibility of the midfoot segment may be particularly desirable as this segment may provide for a great share of the energy return. Thereby, being able to easily assess a condition of the midfoot segment, such as a solidity, firmness or the like may be advantageous.

In some embodiments, the lower midsole layer has a cut-out arranged such that the reinforcing frame is at least partially visible from below the outsole. In some embodiments, the cut-out of the lower midsole layer has an elongated shape aligned along the heel to toe axis of the sole. The cut-out of the lower midsole layer may be arranged such that the midfoot segment of the reinforcing frame is at least partially visible from below the outsole. The cut-out of the lower midsole layer may be shaped substantially in correspondence with the cut-out of the outsole. In some embodiments, the cut-out of the lower midsole layer and the cut-out of the outsole may form one integral cut-out.

The same features and advantages as mentioned in the foregoing embodiment relating to the cut-out of the outsole apply to the cut-out of the lower midsole layer as well.

In some embodiments of the sole for a shoe as described herein, the reinforcing frame is at least partially visible from outside the shoe. In some embodiments, the reinforcing frame is visible from a medial side, a heel side and/or a lateral side of the shoe.

Without wishing to be bound by theory, it is believed that this may have an added benefit of lateral stability and/or of preventing twisting of the ankle. This may be the case, as said visibility means that the reinforcing frame may extend to or may even go slightly beyond an outmost boundary of the midsole, e.g., foam material. This provides for said added benefit.

In addition, the visibility from a medial side, a heel side and/or a lateral side may have the further advantage that the outer appearance of the sole and/or the shoe can be improved. In particular, it could easily indicate to the wearer that the sole is provided with a certain functionality. This visibility may also influence the wearer's performance, confidence, and/or motivation in engaging an athletic activity in a first instance.

In some embodiments of the sole for a shoe as described herein, the reinforcing frame extends from a heel region of the sole to a toe region of the sole.

This further contributes to the advantages of the reinforcing frame as laid out elsewhere herein, e.g., that it provides enhanced energy return to the wearer. In particular, according to such embodiments, the reinforcing frame is provided in a rather large region of the sole, whilst still defining the open space as described elsewhere herein. In this manner, impacts received during any phase of the gait cycle of the wearer may be stored in the reinforcing frame in the form of energy, which be returned to the wearer in order to support a propulsive force in the direction of movement to the wearer. This can provide for enhanced performance.

Such embodiments may also be useful for athletes as they move away from their optimal running form due to fatigue, which may exemplarily happen during running at higher speeds and/or during a long endurance run. Due to the large region encompassed by the reinforcing frame, the wearer can benefit from the reinforcing frame during substantially any kind of running form whether at the beginning, when the wearer is still quite fresh, or more towards the end, when fatigue makes a different running form prevail.

Materials

In some embodiments of the sole for a shoe as described herein, the upper midsole layer comprises a first material and the lower midsole layer comprises a second material. In some embodiments, the first material has a lower stiffness compared to the second material.

This has the advantage that the upper midsole layer can provide for enhanced cushioning to the foot of the wearer. This may be the case as the upper midsole layer may make, at least indirectly, contact with the foot of the wearer. Further, the lower midsole layer having a material that is stiffer can provide for an improved distribution of the forces to an outsole of the sole and/or to the ground.

It is noted that the first material, i.e., the material of the upper midsole layer, may be lighter compared to the second material whilst still providing for a higher energy return to the wearer.

The "stiffness" as referred to herein may be understood as rigidity or modulus of elasticity. It may refer to a material's ability to resist deformation when subjected to an applied force. It may describe how much a material will deflect or stretch in response to an applied load. A stiffer material may experience less deformation under the same load compared to a less stiff material. Stiffness is measured by Young's modulus, which quantifies the relationship between stress (force per unit area) and strain (deformation). Stiffness may often be associated with a material's ability to maintain its shape and resist bending or flexing.

In some embodiments of the sole for a shoe as described herein, the reinforcing frame comprises or consists of one or more of the following materials: thermoplastic polyurethane (TPU) and/or polyamide (for example, nylon polyamide), and/or carbon fibers, and/or a carbon fiber composite material, and/or a glass fiber composite material. The reinforcing frame may additionally or alternatively comprise foam, for example a dense foam, such as an ethylene-vinyl acetate (EVA) foam.

These materials have the advantage to provide sufficient stiffness and can contribute to an enhanced energy return. In addition, these materials may be relatively easy to procure, are cost-effective, and are widely accepted in the sector of soles for shoes.

Further, one or more materials of the following more general exemplary groups of materials may be employed for the reinforcing frame: biological polymers, fiber-reinforced polymers, reinforced polymer composites, or biological fibers.

In some embodiments, the reinforcing frame may be manufactured via a dual injection process. Such a process involves injecting same or different materials, for instance different materials having different properties such as different hardnesses into the same mold. This may have the advantage of providing a reinforcing frame that has different material properties, such as different hardnesses in different areas of the reinforcing frame.

In some embodiments of the sole for a shoe as described herein, the midsole comprises or consists of a particle foam material, for example a particle foam material comprising one or more of the following materials: expanded thermoplastic polyurethane (eTPU), expanded polyamide (ePA), expanded polyether-block-amide (ePEBA), expanded polylactide (ePLA), expanded polyethylene terephthalate (ePET), expanded polybutylene terephthalate (ePBT), expanded thermoplastic polyester ether elastomer (eTPEE), or a combination thereof.

The foam particles are may be made of, or comprise, expanded thermo-plastic materials, for example thermoplastic polyurethane (TPU), polylactate (PLA), polyamide (PA), polyether block amide (PEBA), polyethylene tereph-thalate (PET), polybutylene terephthalate (PBT), or thermoplastic polyester ether elastomer (TPEE). The foam particles may additionally or alternatively be a bead containing multiple polymer types in one foam particle or the foam particles may be a mixture of different particles of different foam polymers, or combinations thereof. In some embodiments, the foam particles consist of 90% by weight of one or a mixture of these materials. These foam particles are particles that comprise a so-called bead foam, also known in the art as a pellet/particle foam. Often the foams derived from the use of connected foam particles are given the designation "e" to denote the bead form of the polymer foam component, for example, eTPU.

Particle foams are useful in providing cushioning and also energy return effect, since such materials may have good elastic and cushioning properties. Moreover, depending on the desired degree of cushioning, support, stability and/or solidity, a softer or harder material may be used. This allows fine-tuning of the response of the midsole under a pressure load on the sole. It may also be possible that the choice of the material for the midsole is subject to the material of the upper and/or of the outsole. This may have an advantage with respect to attachment of the respective parts.

Further advantages of the materials that can be used in accordance with the present disclosure can be found in EP 2 649 896 A2, WO 2016/030026 A1, and WO 2016/030333 A1, the disclosures of which is incorporated herein by reference.

Expanded thermoplastic polyurethane (eTPU) foam is a versatile material that offers several advantages due to its capability in providing comfort, cushioning, insulation and because it is relatively lightweight. Expanded thermoplastic polyurethane (eTPU) particles provide excellent elastic and cushioning properties. Thus, external shocks that arise, for example, when the sole hits the ground may be cushioned such that a pleasant wearing comfort is achieved.

Expanded polyamide (ePA) foam is also an advantageous material for the midsole. Polyamide foam is lightweight, whilst also maintaining high levels of cushioning, energy return and comfort.

In some embodiments of the sole for a shoe as described herein, the midsole comprises or consists of a foam material manufactured in one foaming step. Such foams are often referred to as "homogeneous foams", "block foams" or "integral foams".

These foams are produced in one foaming step using blowing agents and these foams do not have a recognizable granular structure, i.e., they do not have any identifiable particles within the finished foam and only a singular internal cellular structure, unlike bead foams which contain multiple beads each containing an internal cellular structure and with intersections between the individual expanded beads which create a granular structure.

Homogenous foams or block foams can be made from well-known state of the art polymers such as ethylene-vinyl acetate (EVA), thermoplastic polyester ether elastomer (TPEE), polyether-block-amide (PEBA), polyurethane (PU), etc.

In some embodiments of the sole for a shoe as described herein, the reinforcing frame comprises a second part not surrounding the outer boundary of the midsole.

In some embodiments of the sole for a shoe as described herein, the second part comprises the substantially straight midfoot segment of the reinforcing frame.

Shoe

Further, the above-mentioned objects are solved by a shoe, in particular a sports shoe, such as a running shoe, the shoe comprising: a sole according to any one of the embodiments described herein and an upper attached to the sole.

It goes without saying that the technical properties shown or described for the sole, the advantages and the improvements over the state of the art are likewise applicable to the shoe, in particular the sports shoe. Same applies vice versa.

The upper may be attached to the sole by any kind of suitable means of attachment. As understood by the skilled person, attaching the upper of a shoe to the sole may involve various methods and techniques depending on the type of shoe, the materials used, and/or the desired level of durability and robustness of the upper.

FIG. 1 shows a sole 101 for a shoe 100, in particular for a sports shoe 100, according to some embodiments of the present disclosure in an exploded view.

Figure 2:
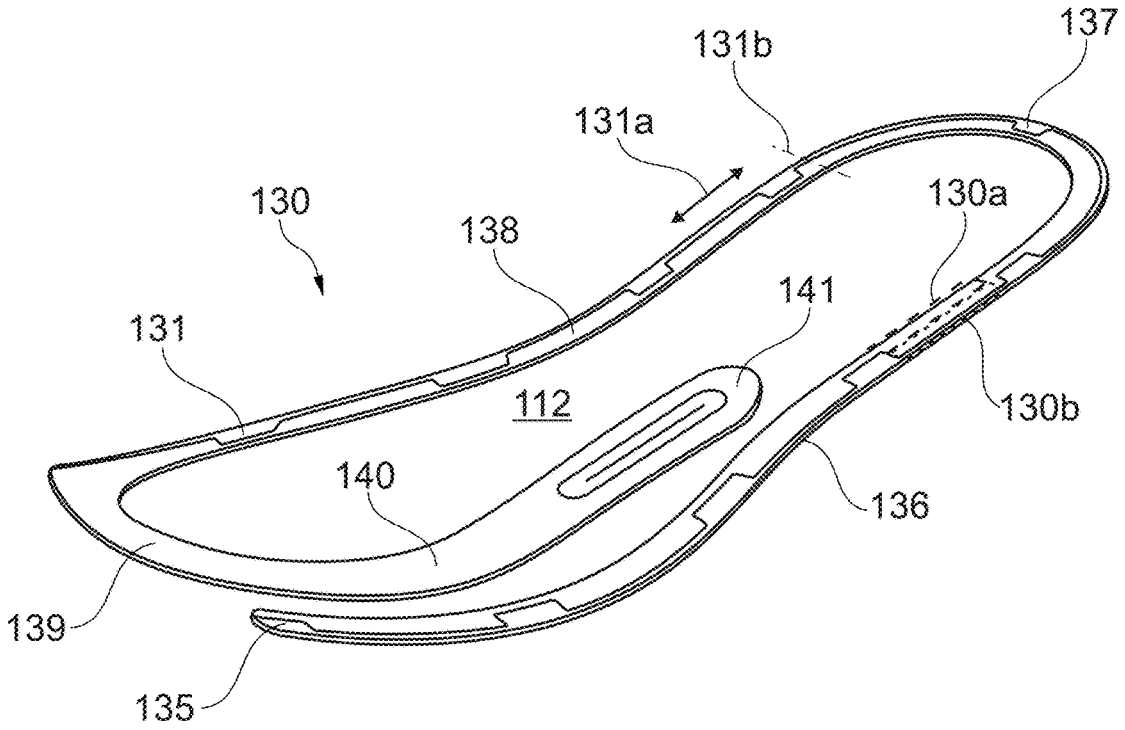
FIG. 2 shows a reinforcing frame for a sole for a shoe according to some embodiments in a first perspective view.

The sole 101 comprises a midsole 110 and a reinforcing frame 130. At least a first part 136, 137, 138, 139 (as indicated in FIGS. 2 to 2C) of the reinforcing frame 130 substantially surrounds an outer boundary 111 of the midsole 110 in one or more of: a lateral side region 116, a medial side region 115, a heel region 117, and a toe region 118 of the midsole 110 thereby defining an open space 112 (the underlining of reference sign 112 in FIG. 1 indicates that the open space comprises at least the region/space enclosed by the reinforcing frame 130). The outer boundary 111 is described in greater detail with reference to FIG. 4.

Moreover, as shown in the exploded view in FIG. 1, a part of the midsole 110 is received in the open space 112.

As shown in FIGS. 2 to 2C, the first part 136, 137, 138, 139 of the reinforcing frame 130 that substantially surrounds an outer boundary 111 of the midsole 110 may be one or more of the following: a substantially straight lateral segment 136, a curved heel segment 137, a substantially straight medial segment 138, and a curved toe segment 139. Correspondingly, the reinforcing frame 130 can comprise a second part, such as a substantially straight midfoot segment 140. As shown in FIG. 1 and from FIGS. 2 to 2C, this second part may not surround an outer boundary 111 of the midsole 110 in one or more of: a lateral side region 116, a medial side region 115, a heel region 117 and a toe region 118 of the midsole 110.

As can be seen, a part of the outer boundary 111 of the midsole 110 that is substantially surrounded by the reinforcing frame 130 faces a lateral side 102 of the sole 101 and/or a medial side 103 of the sole 101. Thereby, the outer boundary 111 may have a normal (such as a normal on a surface) which is at least partially directed to the lateral side 102 of the sole 101 and/or to the medial side 103 of the sole 101. The normal of the outer boundary 111 is understood as the line perpendicular to the surface formed by the outer boundary 111.

The open space 112 is arranged substantially in a plane defined by a heel to toe axis HT and a medial to lateral ML axis of the sole. As understood, since the open space 112 may be three-dimensional, it encompasses more than said plane, however, it may at least extend through said plane as can be seen in FIG. 1.

The midsole 110 comprises an upper midsole layer 120 and a lower midsole layer 125, wherein the reinforcing frame 130 is sandwiched between the upper midsole layer 120 and the lower midsole layer 125. From the exemplary embodiment depicted in the exploded view in FIG. 1, it can be seen that a part of the upper midsole layer 120 is received in the open space 112. However, it is not precluded that further parts of the midsole 110, such as a part of the lower midsole layer 125 are received within the open space 112.

As described elsewhere herein, it may alternatively be possible that the upper midsole layer 120 and the lower midsole layer 125 are formed as one unitary piece, such that they are not separated. In such an alternative, the reinforcing frame 130 may be received at least partially in the midsole 110 by way of grooves, latches, cut-outs, or the like formed in the midsole 110.

The upper midsole layer 120 and the lower midsole layer 125 can be engaged with one another via a form-fit connection, thereby they are defining the outer boundary 111 that is substantially surrounded by the reinforcing frame 130. In some embodiments, the upper midsole layer 120 may be received at least partially in an opening 126 formed by the lower midsole layer 125, which is, subsequent to receiving, substantially filled with the upper midsole layer 120 (as best seen in FIG. 4). As can be gathered from the exploded view in FIG. 1, the reinforcing frame 130 will be placed between the upper midsole layer 120 and the lower midsole layer 125, such that a circumferential surface 129 (also indicated in FIG. 4) of the lower midsole layer 125 substantially abuts the reinforcing frame 130 and presses it against a circumferential surface 121 (also indicated in FIG. 4) of the upper midsole layer 120. The circumferential surfaces 129, 121 of the lower midsole layer 125 and of the upper midsole layer 120 are substantially facing each other, having the reinforcing frame 130 placed therebetween. This can also be seen in greater detail with reference to FIG. 3, FIG. 3A, FIG. 3B, and FIG. 4.

The midsole 110 may comprise a polymer foam material. In this manner, the respective advantages in terms of cushioning and energy return of the physical arrangement of the reinforcing frame 130 and the midsole 110, in particular of the upper midsole layer 120 and of the lower midsole layer 125 become even more pronounced due to the good cushioning properties of the foam material.

As can be seen in FIG. 1, the open space 112 is arranged in at least one of: a heel region 112*a*, a midfoot region 112*b*, and a toe region 112*c* of the sole 101.

The open space may span at least 10%, at least 20%, at least 30%, at least 40%, at least 50%, at least 60%, at least 70%, or at least 80% of an underfoot area 104 of the sole 101, and/or at most 99%, at most 95%, or at most 90% of the underfoot area 104 of the sole 101. The underfoot area 104 of the sole 101 is exemplarily indicated in FIG. 1. The underfoot area 104 may be defined by the heel region 112*a*, the midfoot region 112*b*, and the toe region 112*c* of the sole 101. In other words, the underfoot area 104 may be the area with which the bottom of a foot of a wearer would come into contact (disregarding the presence of an upper 160 and/or an insole), when a shoe 100 comprising such a sole 101 is worn by a wearer.

As can be further seen in FIG. 1, the reinforcing frame 130 extends from a heel region 112*a* of the sole 101 to a toe region 112*c* of the sole 101.

It is noted that the frame-like design of the reinforcing frame 130 offers stiffness and stability in portions under the foot where it is most needed, whilst providing a minimalistic design. Thereby also weight-saving advantages can be achieved.

The reinforcing frame 130 as described herein may serve, for example, to increase the overall stability of the midsole 110, and may provide for a significant increase in energy return to the wearer, without substantially impairing the cushioning and elastic properties of other components of the midsole 110. Hence, the reinforcing frame 130 adds further possibilities to influence the stability properties of the sole 101.

These advantages are particularly pronounced during many athletic activities. That may be the case because a plurality of different movement patterns may be executed by an athlete, including but not limited to the foot of the wearer contacting the ground via a posterior heel strike, a medial heel strike, a lateral heel strike or a medial forefoot strike. These different impact patterns may result in different pressure loads to the sole 101 and to the foot of the wearer. According to the sole 101 of embodiments described herein, these different pressure loads can be beneficially returned to the wearer whilst ensuring improved cushioning.

FIG. 2, FIG. 2A, FIG. 2B, and FIG. 2C show a reinforcing frame 130 for a sole 101 for a shoe 100 according to some embodiments of the present disclosure in four different perspectives. FIG. 2D shows a schematic cross-sectional cut 131*b* (as indicated in FIG. 2) of a reinforcing arm 131 of a reinforcing frame 130 as used in a sole 101 for a shoe 100 according to some embodiments. The features shown in these figures are applicable to all other embodiments of the sole 101 for a shoe 100 described elsewhere herein.

The reinforcing frame 130 comprises an arm 131, which comprises a flattened profile 132 in a cross-sectional cut 131*b* perpendicular to a longitudinal axis 131*a* of the arm 131. The flattened profile 132 has a width w_fp (as best seen in FIG. 2D) substantially in a plane defined by a heel to toe axis HT and a medial to lateral axis ML of the sole 101, of at least 3 mm, at least 5 mm, at least 8 mm, at least 10 mm, at least 12 mm, at least 15 mm, or at least 20 mm, and/or of at most 70 mm, at most 60 mm, at most 50 mm, at most 45 mm, at most 40 mm, at most 35 mm, at most 30 mm, or at most 25 mm.

Further, the flattened profile 132 has a thickness t_fp substantially perpendicular to a plane defined by a heel to toe axis HT and a medial to lateral axis ML of the sole 101, of at least 0.2 mm, at least 0.5 mm, at least 0.8 mm, at least 1.0 mm, at least 1.2 mm, at least 1.5 mm, and/or of at most 3 mm, at most 2.5 mm, at most 2.0 mm, at most 1.8 mm, or at most 1.5 mm. The reinforcing frame 130 may have a substantially a uniform thickness. However, as shown in particular from FIG. 2, FIG. 2A, and FIG. 2B, the reinforcing frame 130 may be provided with structures, such as raised structures and/or embossed structures. These structures may have any shape and may serve the purpose of reinforcing some portions of the reinforcing frame 130. In one example, these structures may be provided in substantially regular patterns along the length of the arm 131. For instance, it can be seen from FIG. 2A, that such structures are provided at least along a lateral segment 136 (as described further below), along a heel segment 137, and/or along a medial segment 138 of the arm 131 of the reinforcing frame 130.

The reinforcing frame 130 is formed so as to define a three-dimensional shape, such that it is arranged in at least two substantially parallel planes 142, 143 defined by the heel to toe axis HT and the medial to lateral axis ML of the sole 101, the two planes 142, 143 being spaced apart (indicated by "s" in FIG. 2C) by at least 1 cm, at least 1.5 cm, at least 2 cm, at least 2.5 cm, at least 3 cm, at least 3.5 cm, or at least 3.6 cm, and/or by at most 5 cm, at most 4.5 cm, at most 4.2 cm, or at most 4.0 cm. The two substantially parallel planes 142, 143 are indicated in FIG. 2C by way of the dashed lines and are understood to project into infinite space in a horizontal direction.

As best seen in FIG. 2C, a heel segment 137 of the reinforcing frame 130 can extend by a greater amount in an upward direction UD compared to any other segment 136, 138, 139, 140 of the reinforcing frame 130.

As shown in FIG. 2, FIG. 2A, FIG. 2B, and FIG. 2C, the reinforcing frame 130 comprises an open frame structure having a first end 135 and a second end 141, wherein the first end 135 and the second end 141 are spaced apart from each other. The first end 135 and the second end 141 may be spaced apart from each other by at least 10%, at least 20%, at least 30%, at least 40%, or at least 50% of the length of the sole 101 (as best seen in FIG. 1), and/or of at most 80%, at most 70%, at most 60%, or at most 50% of the length of the sole 101. It is understood that the length of the sole 101 may be measured along the heel-to-toe axis HT of the sole 101.

The first end 135 may be arranged in a toe region 112*c* of the sole 101. In some embodiments, the first end 135 may be arranged in a little toe region of the sole 101. The second end 141 may be arranged in a midfoot region 112*b* of the sole 101.

The reinforcing frame 130 may have the following segments 136, 138, 139, 140 in the following order from the first end 135 to the second end 141: a substantially straight lateral segment 136, a curved heel segment 137, a substantially straight medial segment 138, a curved toe segment 139, and a substantially straight midfoot segment 140.

It is noted that the midfoot region 112*b* of the sole 101 and/or the toe region 112*c* of the sole 101 portion may be subject to a range of movements and/or pressures during athletic activities. Therefore, improvements to these regions 112*b*, 112*c* contribute to a more comfortable and enhanced sole 101.

It is noted that, although the reinforcing frame 130 comprises a midfoot segment 140, the reinforcing frame 130 can nonetheless define an open space 112 in the midfoot region 112*b* of the sole 101. This is shown for example in FIG. 2B and FIG. 2C.

Figure 2A:
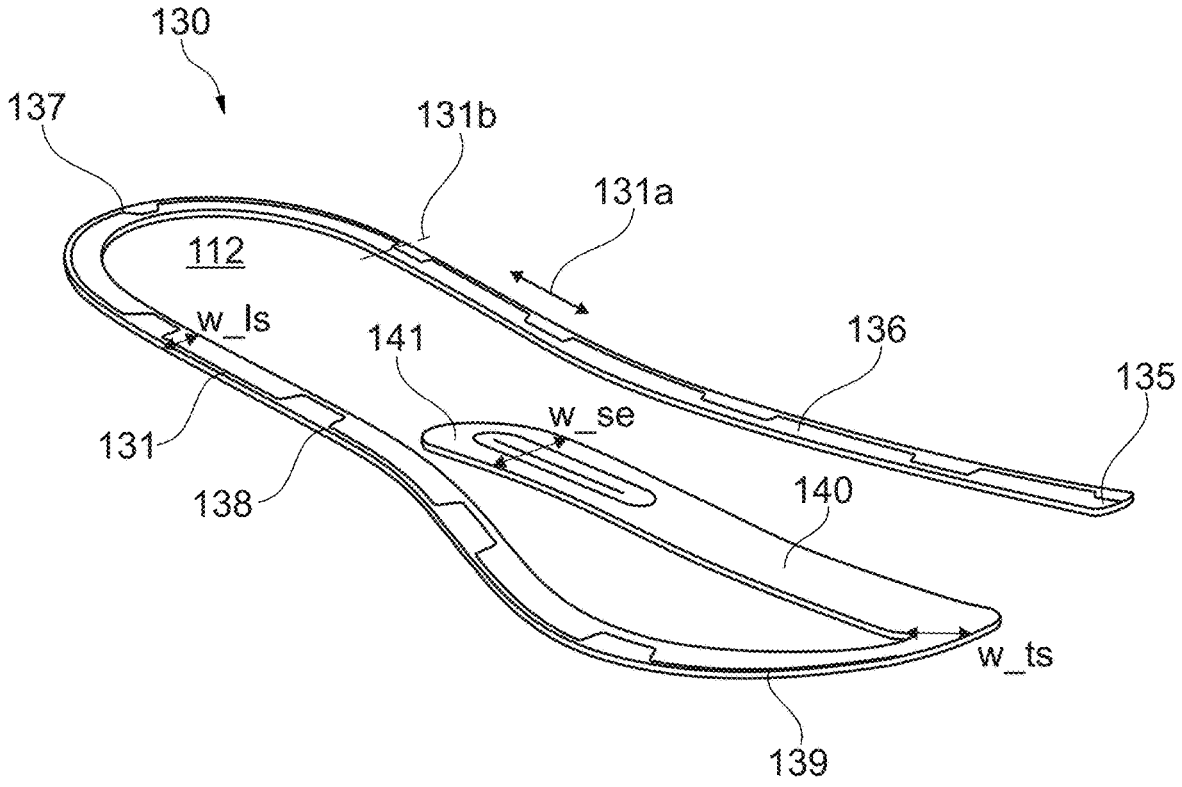
FIG. 2A shows a reinforcing frame for a sole for a shoe according to some embodiments in a second perspective view.
Figure 2B:
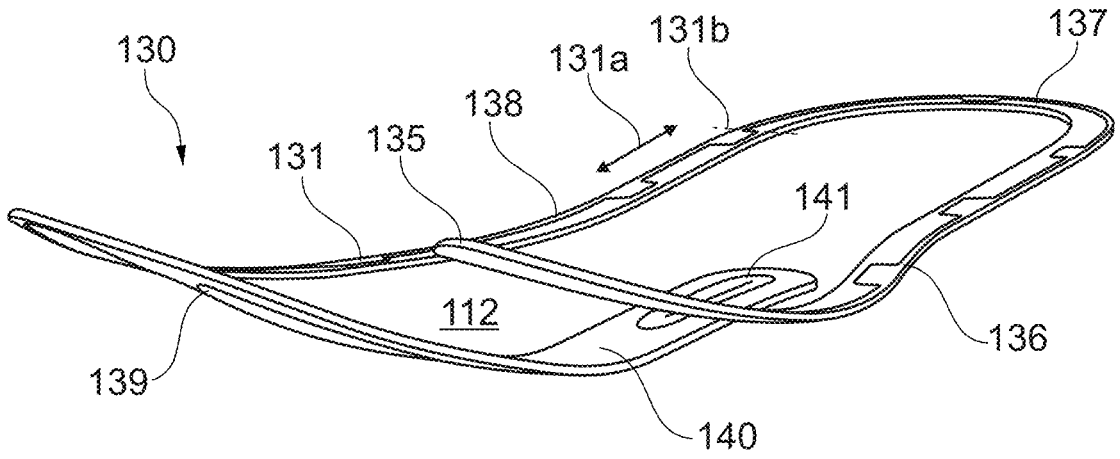
FIG. 2B shows a reinforcing frame for a sole for a shoe according to some embodiments in a third perspective view.
Figure 2C:
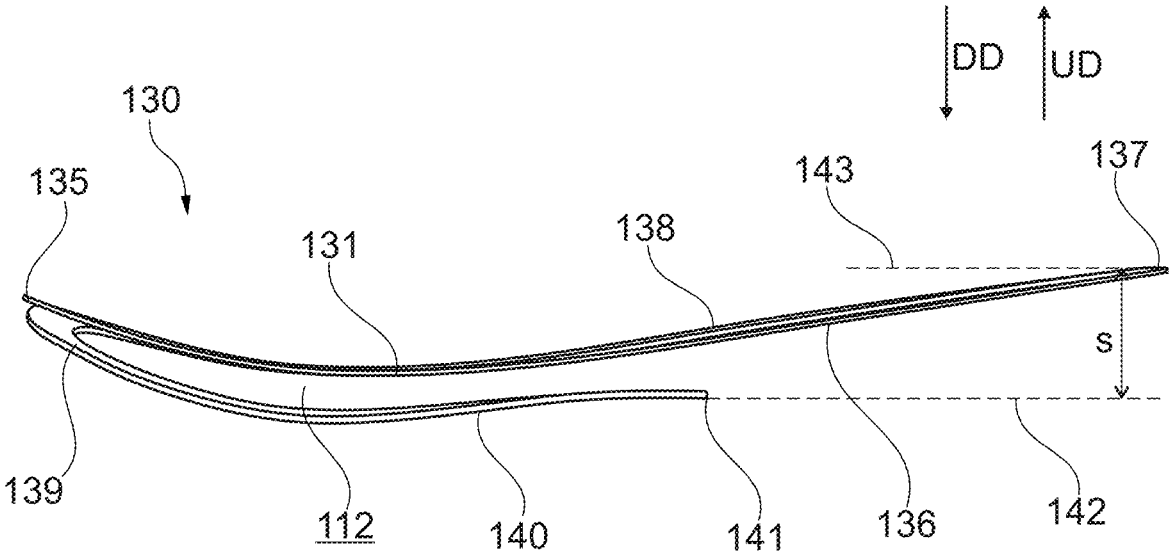
FIG. 2C shows a reinforcing frame for a sole for a shoe according to some embodiments in a fourth perspective view.
Figure 2D:
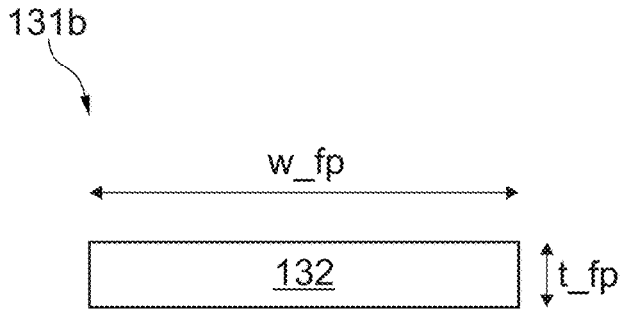
FIG. 2D shows a schematic cross-sectional view of a reinforcing arm of a reinforcing frame according to some embodiments.

As shown in FIG. 2 and FIG. 2A, a width w_se of the midfoot segment 140, in particular the width w_se of the second end 141, is greater than any other width (e.g., the width w_ts of the toe segment 139 and the width w_ls of the lateral segment 138 are exemplarily indicated in FIG. 2A) of the reinforcing frame 130, the width w_se being substantially along a plane defined by a heel to toe axis HT and a medial to lateral axis ML of the sole 101.

Further, the width w_se of the reinforcing frame 130 decreases from the second end 141 along the midfoot segment 140 towards the toe segment 139, the width w_se being substantially in a plane defined by a heel to toe axis and a medial to lateral axis of the sole.

As shown in FIG. 2C, the midfoot segment 140, in particular the second end 141, can extend by a greater amount in a downward direction DD compared to any other segment 136, 138, 139, 140 of the reinforcing frame 130.

In one example, the three-dimensional shape may be understood such that the reinforcing frame 130 may be formed so as to define a helical shape. A helical shape may be a shape that resembles a helix or spiral. A helix is a curve that winds around a central axis. In one example, a helix may wind around a central axis in a consistent manner, creating a spiral-like pattern. In another example, a distance to the central axis may vary, which may adapt the shape of the reinforcing frame 130 to the shape of the midsole 110.

In one example, the reinforcing frame 130 as shown in FIG. 2, FIG. 2A, FIG. 2B, and FIG. 2C, may be understood to be constructed so as to form a sling shot, starting substantially under the little toe of a wearer, wrapping around the heel of the wearer, running underneath the big toe of the wearer and back underneath the midfoot of the wearer. This has the advantage that the reinforcing frame 130 provides for a stiff construction, which is capable of storing a large charge of energy upon ground contact of the sole and to provide a large energy return to the wearer in order to increase a propulsive force into the direction of running.

This construction facilitates stiffening of the midfoot portion to forefoot portion resulting in an enhanced energy return whilst also stabilizing the landing phase of the wearer and supporting the wearer. This may be helpful when the gait cycle of the wearer is not ideal and/or varies depending on the fatigue of the wearer.

As shown in FIG. 2, an exemplary dashed box 130*a* and an exemplary dashed box 130*b* are indicated, which can represent a first portion 130*a* of the reinforcing frame 130 and a second portion 130*b* of the reinforcing frame 130.

The first portion 130*a* of the reinforcing frame 130 may be covered and/or embedded in the midsole 110 when the sole 101 is in an assembled condition (as can be derived from the exploded view in FIG. 1). It is noted that this first portion 130*a* may be different than the second part of the reinforcing frame 130, such as the substantially straight midfoot segment 140 (which may not surround the outer boundary 111 of the midsole 110). This means that the first portion 130*a* of the reinforcing frame 130 is considered to surround the outer boundary 111 of the midsole 110 as described elsewhere herein in greater detail.

The second portion 130*b* of the reinforcing frame 130 may be exposed to the exterior when the sole 101 is in an assembled condition (as can be derived from the exploded view in FIG. 1).

The size of the first portion 130*a* and/or of the second portion 130*b* can vary as understood by the skilled person. In particular, the first portion 130*a* and/or of the second portion 130*b* may extend along one or more of: the substantially straight lateral segment 136, the curved heel segment 137, the substantially straight medial segment 138, and the curved toe segment 139. Further, their width may vary depending on the specific arrangement of the sole 101, as understood by the skilled person. Thus, the size of the first portion 130*a* and/or of the second portion 130*b* is indicated merely by way of example in FIG. 2.

Figure 3:
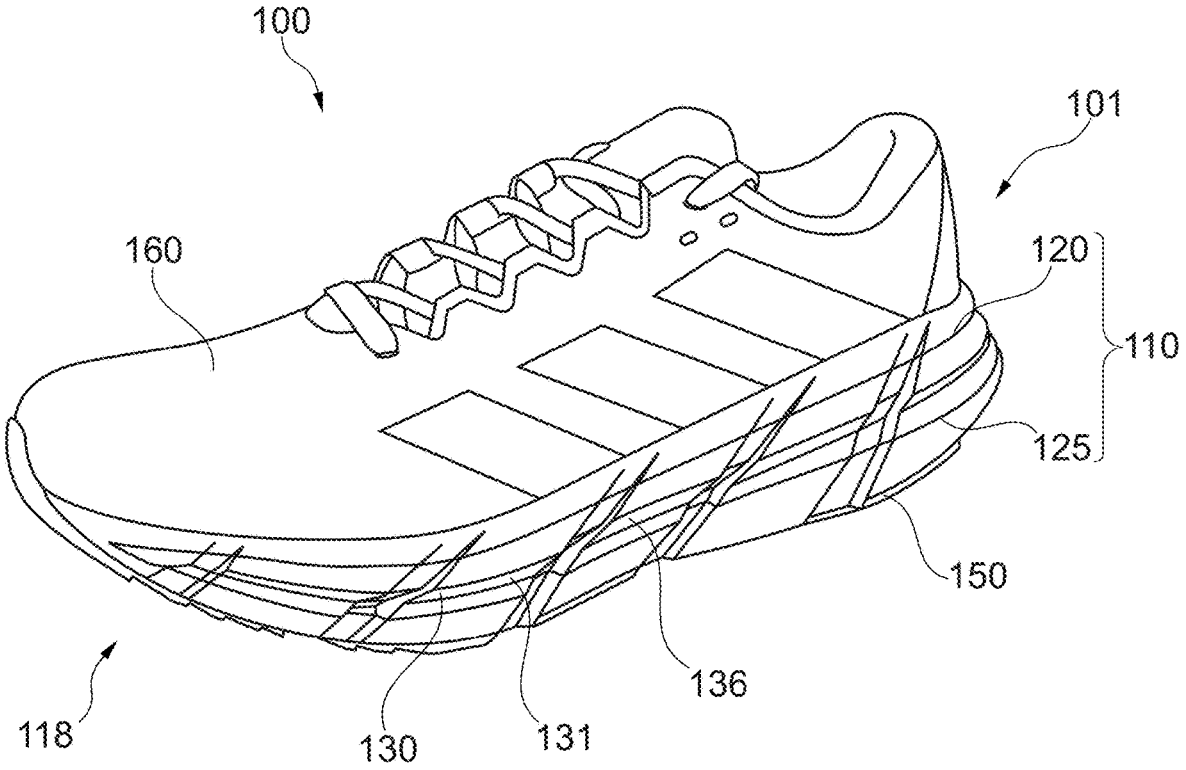
FIG. 3 shows a shoe, in particular a sports shoe, comprising an upper according to some embodiments in a first perspective view.
Figure 3A:
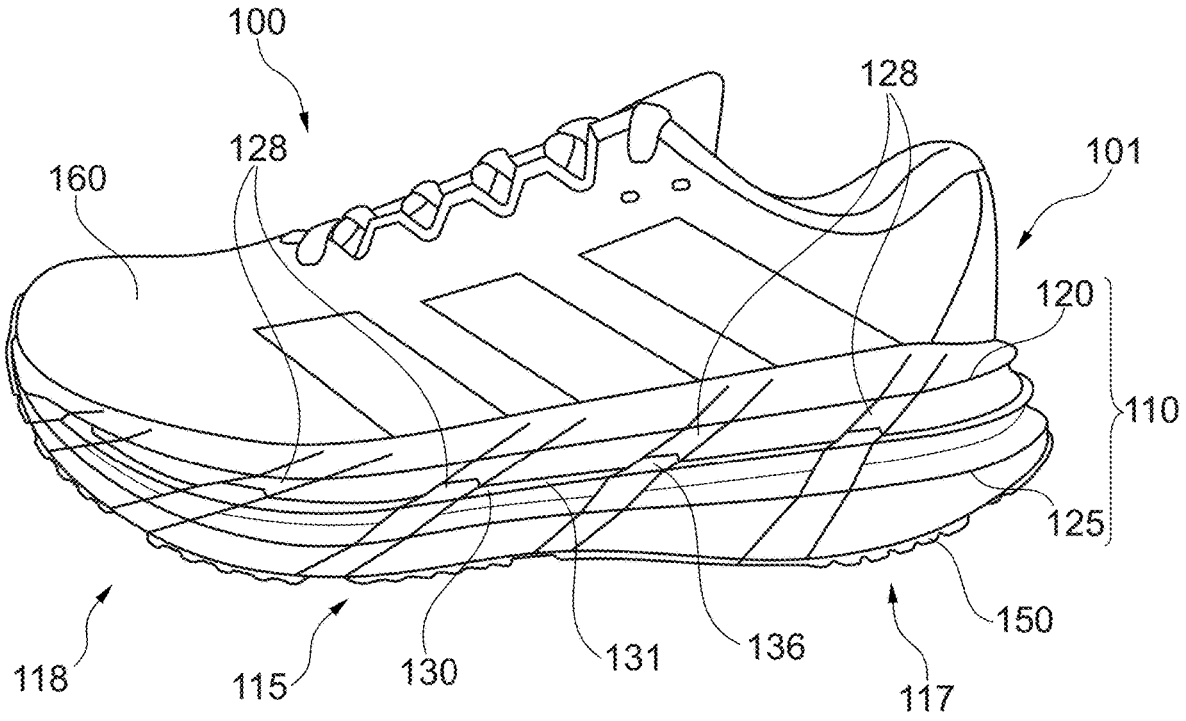
FIG. 3A shows a shoe, in particular a sports shoe, comprising an upper according to some embodiments in a second perspective view.
Figure 3B:
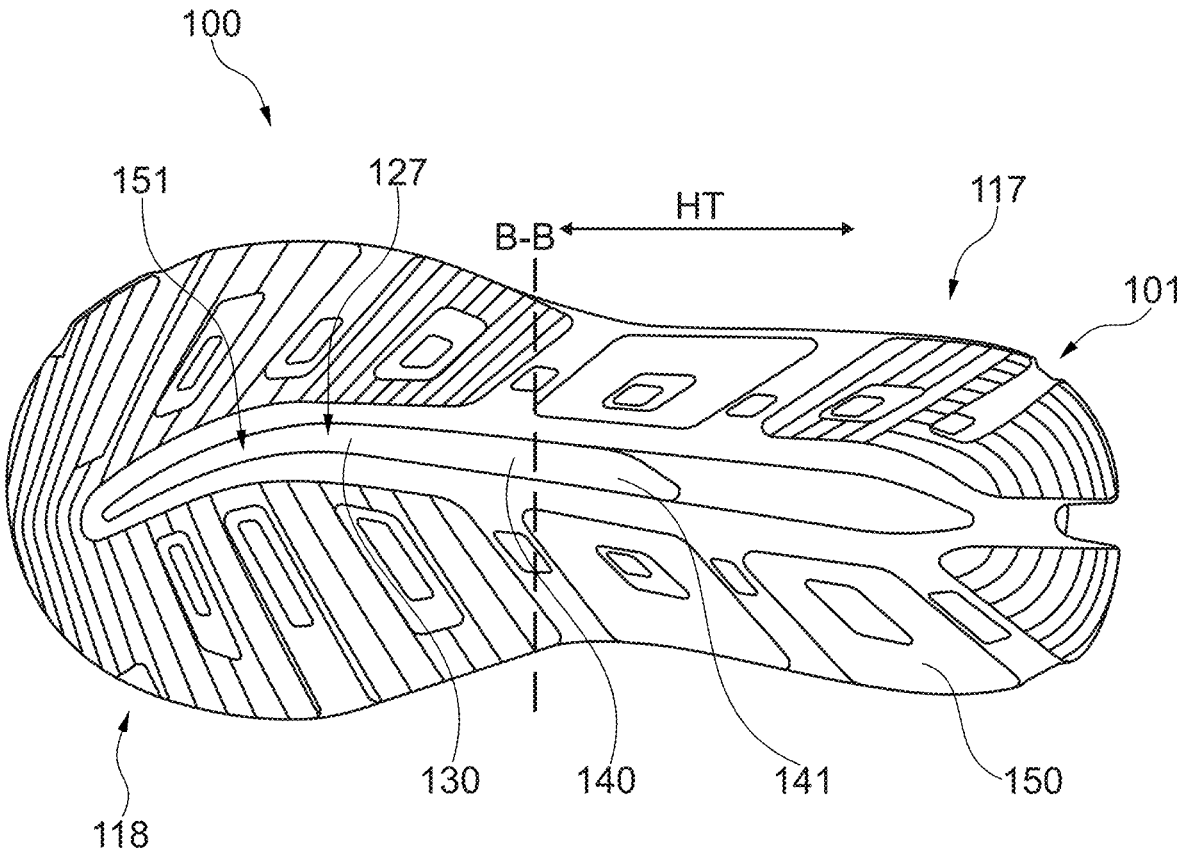
FIG. 3B shows a shoe, in particular a sports shoe, comprising an upper according to some embodiments in a third perspective view.
Figure 4:
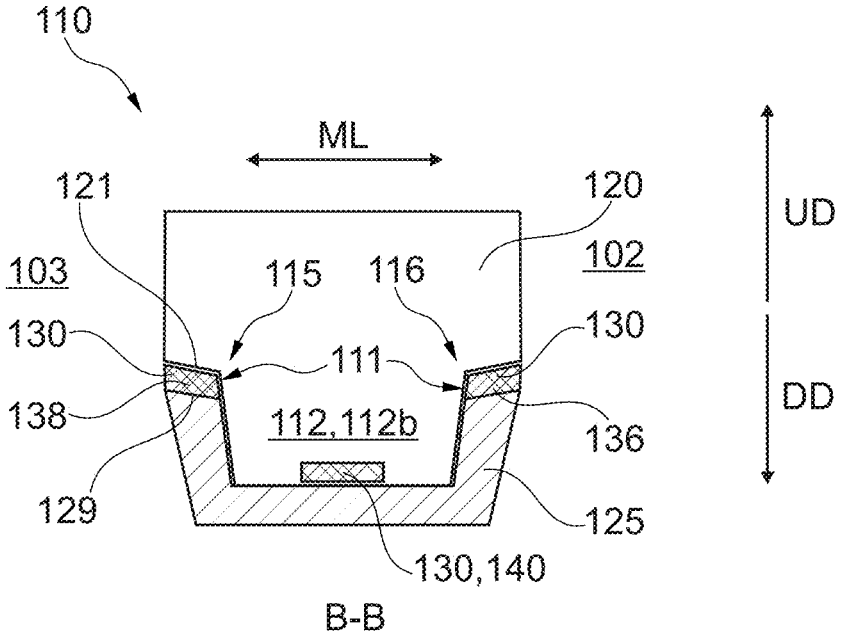
FIG. 4 shows a schematic cross-sectional view (as indicated by the cross-sectional cut B-B in FIG. 3B and FIG. 3C) of a midsole of a sole for a shoe according to some embodiments.

FIG. 3, FIG. 3A, and FIG. 3B show a shoe 100, in particular a sports shoe 100, comprising an upper 160 according to some embodiments of the present disclosure in three different perspectives. The features shown in these figures are applicable to all other embodiments of the sole 101 for a shoe 100 described elsewhere herein.

The sole 101 comprises an outsole 150 arranged below the lower midsole layer 125. The outsole 150 has a cut-out 151 (as best seen in FIG. 3B), arranged such that the reinforcing frame 130 is at least partially visible from below the outsole 150. The cut-out 151 may have an elongated shape aligned along the heel to toe axis HT of the sole 101.

The cut-out 151 is arranged such that the midfoot segment 140 of the reinforcing frame 130 is at least partially visible from below the outsole 150.

In addition, the lower midsole layer 125 has a cut-out 127 arranged such that the reinforcing frame 130 is at least partially visible from below the outsole 150. This cut-out 127 may have an elongated shape aligned along the heel to toe axis HT of the sole 101. The cut-out 127 of the lower midsole layer 125 may be arranged such that the midfoot segment 140 of the reinforcing frame 130 is at least partially visible from below the sole 101. The cut-out 127 of the lower midsole layer 125 may be shaped substantially in correspondence with the cut-out 151 of the outsole 150. Such cut-outs 151, 127 have, on the one side, the advantage that less material is required for manufacturing. On the other side, they allow to indicate the wearer and/or personnel to assess the condition of the reinforcing frame 130. In addition, the cut-outs 151, 127 may allow for breathability, e.g., they may allow for air circulation and moisture wicking which can reduce overheating and sweat accumulation. In addition, the cut-outs 151, 127 may have the further advantages that due to a reduction of moisture, the longevity of the shoe may be enhanced. Moreover, the cut-outs 151, 127 may have the further advantage of reducing the weight of the midsole, thereby reducing the overall weight of the sole 101 and the shoe 100. A lightweight shoe 100 is particularly advantageous when it is used for an athletic activity like running.

One or both of the cut-outs 151, 127 may have a length in a longitudinal direction of the outsole 150 and/or of the midsole 110, such as along the heel to toe axis HT, of at least 2 cm, at least 4 cm, at least 6 cm, at least 8 cm, at least 10 cm, at least 12 cm, at least 15 cm, at least 20 cm, at least 25 cm, or at least 30 cm.

One or both of the cut-outs 151, 127 may have a tapered shape along the heel to toe axis HT.

Further, as shown in FIG. 3 and FIG. 3A, the reinforcing frame 130 can be at least partially visible from outside the shoe 100. For instance, the reinforcing frame 130 can be visible from a medial side 103, a heel side and/or a lateral side 102 of the sole 101.

Moreover, in some embodiments, one or more recesses 128 may be provided in the lateral side region 116 of the midsole 110 and/or the medial side region 115 of the midsole 110 or, in other words, in the sidewalls of the midsole 110. In FIG. 3A, four recesses 128 are indicated. The one or more recesses 128 may have an elongated shape. In some embodiments, the one or more recesses 128 are angled with respect to an upward direction UD and downward direction DD, wherein the angle increases from a recess 128 arranged in a front portion to a recess 128 in a rear portion of the midsole 110. The increase of the angle may be substantially continuous. The one or more recesses 128 may be substantially continuously formed across the upper midsole layer 120 and the lower midsole layer 125 as depicted in FIG. 3A. Further, as the one or more recesses 128 provide for a space in the material of the midsole 110, the reinforcing frame 130 is visible to a greater extent in these recesses 128.

The one or more recesses 128 may have the advantage that the reinforcing frame 130 does not completely abut a lower circumferential surface 121 of the upper midsole layer 120 and/or an upper circumferential surface 129 of the lower midsole layer 125. This may allow for some variations and fine-tuning in terms of energy return to the wearer.

The one or more recesses 128 may not be through holes. The one or more recesses 128 may have the shape of one of a slit, a groove, a cut, or a vent. These shapes may have the potential to impart certain functional properties to the midsole 110. For instance, a distribution of the pressure load may be influenced thereby to a greater extent. This may be appreciated by an athlete performing his or her athletic activity. In addition, the shapes may be described as follows and have the following advantages:

A slit may be a rather long, narrow opening and/or a cut in a material, such as a material of the midsole 110. A slit typically has a length that is greater than its width, in some instances its length is significantly greater than is width. For instance, its length may be greater than its width by a factor of at least two, at least three, at least four, at least five, at least six, at least seven, at least eight, at least nine, at least ten or even greater. Slits can be straight or curved and they can be composed of one or more straight segments and one or more curved segments. Further, the one or more recesses 128 being shaped like slits may, together with one or more remaining parts of the sole 101 be designed to collapse and/or to facilitate a guided deformation of the sole 101.

A groove may be a long, narrow channel and/or recessed portion, which may be cut into a material, such as a material of the midsole 110. The grooves may be useful for various purposes, such as guiding the flow of liquids, or the like. This may aid in removing moisture resulting from sweat or the like. In turn this can also improve odor. The grooves can be shallow and/or deep. As understood by the skilled person, this may depend on the thickness of the midsole 110. The grooves may be wide or narrow. The grooves may appear in a variety of shapes, including one or more of straight segments, curved segments, corner segments, regular segments, or irregular segments.

A cut may refer to a separation or division made in a material, such as a material of the midsole 110. A cut may be provided by applying a sharp edge or tool into the material. Cuts may be straight or angled and can be used for a wide range of purposes, including creating openings, shaping materials, or altering the structure of an object, such as the midsole 110. The cuts may appear in a variety of shapes, including one or more of straight segments, curved segments, corner segments, regular segments, or irregular segments.

A vent is an opening or passage in a material, such as a material of the midsole 110. A vent may allow for movement of gases, such as air, or liquids therethrough. Vents may be useful in regulating a temperature of the foot of the wearer. The vents may be implemented by various different shapes and/or size sizes, including one or more of straight segments, curved segments, corner segments, regular segments, or irregular segments.

The upper 160 may be attached to the sole 101 by any kind of suitable means of attachment. For instance, the attachment may include cementing/adhesive bonding, which is a common method, in which for instance a strong adhesive is applied to one or both of the upper 160 and the sole 101. Subsequently, the upper 160 and the sole 101 may be pressed together and allowed to bond. This method may be employed for sports shoes, casual shoes, or the like. Further, the attachment may include stitching the upper 160 to the sole 101. Such a method may involve sewing the upper 160 and the sole 101 together. The stitching may be fully or at least partially visible or fully or at least partially hidden within the sole 101. Further, the attachment may include injection molding. Such a method may involve injecting molten material into a mold that shapes both the sole 101 and the lower part of the upper 160 separately or together. Once the parts are substantially cooled and/or solidified, the upper 160 and the sole 101 may be fused together. This may be performed in some types of sports shoes. Further, the attachment may include direct injection molding. In such a method, a sole 101 material may be directly injected around the upper 160. In turn, this may result in a seamless and strong bonding of the upper 160 and the sole 101. It may often be used in sporty and/or outdoor articles of footwear. Further, the attachment may include the application of soling sheets, which comprise soling material (such as rubber and/or EVA), which are cut to shape and then attached to the sole 101 and upper 160 using adhesive and/or heat bonding. Further, the attachment may include strobel stitching, which may often be performed in athletic shoes and/or casual shoes. In such a method, the upper 160 is stitched to an insole before being attached to the sole 101 using adhesive or cementing. Further, the attachment may include crimping, in which crimps comprising metal and/or plastic are used to join the upper 160 and sole 101 together. Further, the attachment may include lasting. Such a lasting method may involve pulling the upper 160 over a last (i.e., a shoe-shaped form) and securing it to the sole 101 by tacking, stitching, and/or cementing. Further, the attachment may include vulcanization. In such a method, rubber soles 101 may be employed, which are cured in order to bond it with the upper 160. It is often employed in some types of athletic shoes. Further, the upper 160 may be attached to the sole 101 by means of fusion bonding, thermal bonding, ultrasonic bonding, or the like.

Figure 3C:
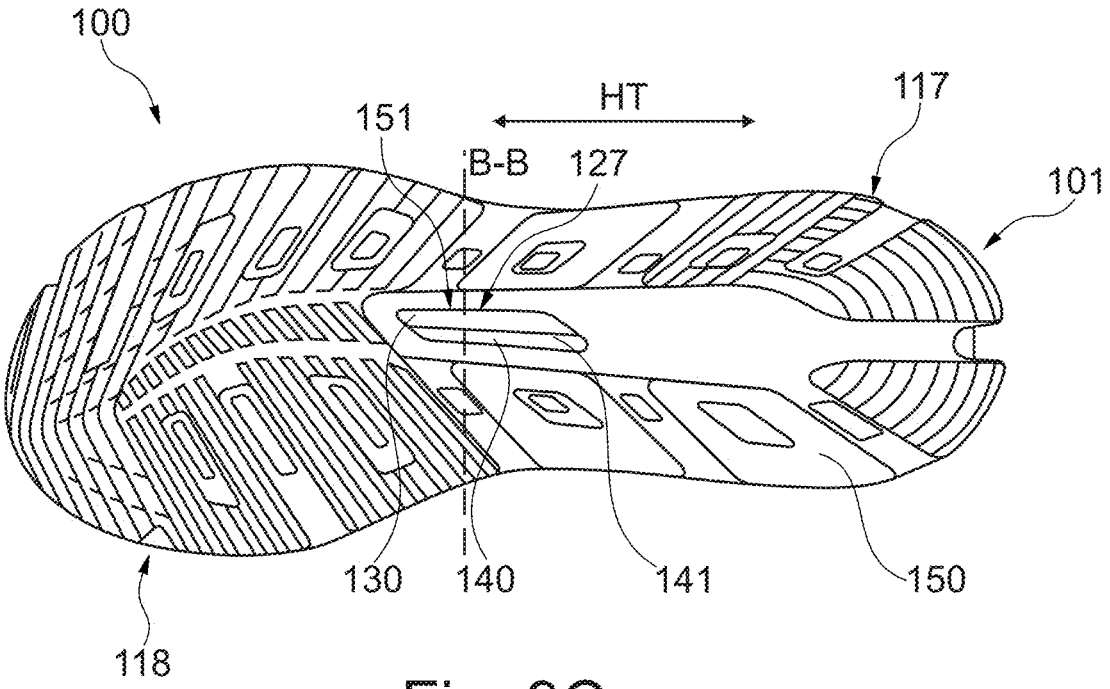
FIG. 3C shows a shoe, in particular a sports shoe, comprising an upper according to some embodiments in a perspective view from the bottom.

FIG. 3C shows a shoe 100, in particular a sports shoe 100, comprising an upper 160 according to some embodiments of the present disclosure in a perspective view from the bottom. The features shown in these figures are applicable to all other embodiments of the sole 101 for a shoe 100 described elsewhere herein. As can be seen, the lower midsole layer 125 has a cut-out 127, arranged such that the reinforcing frame 130 is at least partially visible from below the outsole 150. This cut-out 127 has a different shape as compared to FIG. 3B. The cut-out 127 extends from a heel region 117 of the lower midsole layer 125 towards a midfoot portion of the lower midsole layer 125. The cut-out 127 of the lower midsole layer 125 may be shaped substantially in correspondence with the cut-out 151 of the outsole 150. Similar advantages of the cut-outs 151, 127 as explained with respect to FIG. 3B apply to this embodiment as well.

FIG. 4 shows a schematic cross-sectional view of a midsole 110 as used in a sole 101 for a shoe 100 according to some embodiments of the present disclosure. The schematic cross-sectional view of this figures is indicated via the cross-sectional cut B-B in FIG. 3B and FIG. 3C. The features shown in this figure are applicable to all other embodiments of the sole 101 for a shoe 100 described elsewhere herein.

As can be seen in FIG. 4, the outer boundary 111 of the midsole 110 may be a surface of the midsole 110, the normal of which is substantially perpendicularly to the upward direction UD and downward direction DD.

Further, the outer boundary 111 of the midsole 110 may define the outer shape of the midsole 110 at least partially. The outer boundary 111 of the midsole 110 may be referred to as the part that is visible when the midsole 110 is viewed from the outside, e.g., from a side of the sole 101, such as a medial side and/or a lateral side. As understood, since the reinforcing frame 130 substantially surrounds the outer boundary 111 of the midsole 110, the outer boundary 111 may not be fully visible from outside the shoe 100.

In addition, FIG. 4 shows the open space 112, which is defined by the reinforcing frame 130 and which is free from the reinforcing frame 130. Since FIG. 4 is a cross-sectional cut in a midfoot region 112*b* of the sole 101, the midfoot region 112*b*, which is encompassed by the open space 112, is also depicted. A part of the midsole 110 is received in the open space 112. In the example of FIG. 4, a part of the upper midsole layer 120 is received in the open space 112. In order words, the upper midsole layer 120 fills out at least partially the open space 112 so as to engage with the lower midsole layer 125.

As can be further shown FIG. 4, the reinforcing frame 130 in the cross-sectional cut has a midfoot segment 140, which is spaced further in the downward direction DD as compared to the medial segment 138 and/or lateral segment 136.

In any of the embodiments of the sole 101 for a shoe 100 as described herein, the upper midsole layer 120 can comprise a first material and the lower midsole layer 125 can comprise a second material. In some embodiments, the first material has a lower stiffness compared to the second material.

In any of the embodiments of the sole 101 for a shoe 100 as described herein, the reinforcing frame 130 can comprise or consist of one or more of the following materials: thermoplastic polyurethane (TPU), polyamide (for example nylon polyamide), carbon fibers, a carbon fiber composite material, or a glass fiber composite material.

In any of the embodiments of the sole 101 for a shoe 100 as described herein, the midsole 110 can comprise or consist of a particle foam material, for example a particle foam material comprising one or more of the following materials: expanded thermoplastic polyurethane (eTPU), expanded polyamide (ePA), expanded polyether-block-amide (ePEBA), expanded polylactide (ePLA), expanded polyethylene terephthalate (ePET), expanded polybutylene terephthalate (ePBT), or expanded thermoplastic polyester ether elastomer (eTPEE).

In any of the embodiments of the sole 101 for a shoe 100 as described herein, the foam particles used for the midsole 110 may be made of, or comprise, expanded thermo-plastic materials, for example thermoplastic polyurethane (TPU), polylactate (PLA), polyamide (PA), polyether block amide (PEBA), polyethylene terephthalate (PET), polybutylene terephthalate (PBT), or thermoplastic polyester ether elastomer (TPEE). In any of the embodiments of the sole 101 for a shoe 100 as described herein, the foam particles used for the midsole 110 may also be a bead containing multiple polymer types in one foam particle or the foam particles may be a mixture of different particles of different foam polymers or combinations thereof. In any of the embodiments of the sole 101 for a shoe 100 as described herein, the foam particles used for the midsole 110 consist of 90% by weight of one or a mixture of these materials. The particles are described elsewhere herein in greater detail.

In any of the embodiments of the sole 101 for a shoe 100 as described herein, the midsole 110 can comprise or consist of a foam material manufactured in one foaming step. As described elsewhere herein in greater detail, such foams are often referred to as "homogeneous foams", "block foams" or "integral foams".

As described elsewhere herein in greater detail, these foams that can be used as a material for the midsole 110 in any one of the embodiments of the sole 101 for a shoe 100 as described herein are produced in one foaming step using blowing agents and these foams do not have a recognizable granular structure, i.e., they do not have any identifiable particles within the finished foam and only a singular internal cellular structure, unlike bead foams which contain multiple beads each containing an internal cellular structure and with intersections between the individual expanded beads which create a granular structure.

Homogenous foams or block foams can be made from well-known state of the art polymers such as ethylene-vinyl acetate (EVA), thermoplastic polyester ether elastomer (TPEE), polyether-block-amide (PEBA), polyurethane (PU), etc.

Particle foam material or particle foam on the other hand is different compared to homogeneous foam. To produce particle foam, expanded particles (or beads) are created in a first step from a particulate base material that is foamed. These expanded beads can then be assembled in a second step to form a coherent structure in which the individual particle boundaries are discernible, i.e., clearly visible, in the finished foam. Expanded in this context means that each individual particle has a core of foamed material with many small foam cells, i.e., the particle may not consist of a compact, solid material.

It is noted that any one or more of the embodiments described herein and/or examples may be combined with further aspects as described herein and details of the embodiments and/or examples may also be omitted, as will be understood by the skilled person. The scope of protection is determined by the claims and is not limited by the embodiments and/or examples disclosed in the above figures.

While various embodiments have been described herein, they have been presented by way of example, and not limitation. It should be apparent that adaptations and modifications are intended to be within the meaning and range of equivalents of the disclosed embodiments, based on the teaching and guidance presented herein. It therefore will be apparent to one skilled in the art that various changes in form and detail can be made to the embodiments disclosed herein without departing from the spirit and scope of the present disclosure. The elements of the embodiments presented herein are not necessarily mutually exclusive, but can be interchanged to meet various situations as would be appreciated by one of skill in the art.

The examples are illustrative, but not limiting, of the present disclosure. Other suitable modifications and adaptations of the variety of conditions and parameters normally encountered in the field, and which would be apparent to those skilled in the art, are within the spirit and scope of the disclosure.

It is to be understood that the phraseology or terminology used herein is for the purpose of description and not of limitation. The breadth and scope of the present disclosure should not be limited by any of the above-described exemplary embodiments, but should be defined in accordance with the following claims and their equivalents.

What is claimed is:

1. A sole for a shoe, the sole comprising:

a midsole; and a reinforcing frame, wherein at least a first part of the reinforcing frame substantially surrounds an outer boundary of the midsole in one or more of: a lateral side region, a medial side region, a heel region, and a toe region of the midsole thereby defining an open space, wherein the reinforcing frame comprises an open frame structure having a first end and a second end, wherein the first end and the second end are spaced apart from each other, wherein the reinforcing frame has the following segments in the following order from the first end to the second end: a substantially straight lateral segment, a curved heel segment, a substantially straight medial segment, a curved toe segment, and a substantially straight midfoot segment, and wherein a part of the midsole is received in the open space.

2. The sole according to claim 1, wherein a part of the outer boundary of the midsole that is substantially surrounded by the reinforcing frame faces a lateral side of the sole and/or a medial side of the sole.

3. The sole according to claim 1, wherein the open space is arranged substantially in a plane defined by a heel to toe axis and a medial to lateral axis of the sole.

4. The sole according to claim 1, wherein the midsole comprises an upper midsole layer and a lower midsole layer, and wherein the reinforcing frame is sandwiched between the upper midsole layer and the lower midsole layer.

5. The sole according to claim 4, wherein the upper midsole layer defines the outer boundary of the midsole that is substantially surrounded by the reinforcing frame, and the upper midsole layer and the lower midsole layer are engaged with one another via a form-fit connection, thereby defining the outer boundary of the midsole.

6. The sole according to claim 4, wherein the upper midsole layer is received at least partially in an opening formed by the lower midsole layer.

7. The sole according to claim 4, wherein the lower midsole layer has a cut-out arranged such that the reinforcing frame is at least partially visible from below the lower midsole layer.

8. The sole according to claim 1, wherein the open space spans at least 10% to at most 99% of an underfoot area of the sole.

9. The sole according to claim 1, wherein the reinforcing frame comprises an arm that comprises a flattened profile in a cross-sectional cut perpendicular to a longitudinal axis of the arm.

10. The sole according to claim 9, wherein the flattened profile has a width substantially in a plane defined by a heel to toe axis and a medial to lateral axis of the sole, and wherein the width ranges from at least 3 mm to at most 70 mm.

11. The sole according to claim 9, wherein the flattened profile has a thickness substantially perpendicular to a plane defined by a heel to toe axis and a medial to lateral axis of the sole, and wherein the thickness ranges from at least 0.2 mm to at most 3 mm.

12. The sole according to claim 1, wherein the reinforcing frame is formed so as to define a three-dimensional shape, such that a rearmost portion of the heel segment extends at least 1 cm to at most 5 cm further in an upward direction compared to the second end.

13. The sole according to claim 1, wherein the heel segment of the reinforcing frame extends by a greater amount in an upward direction compared to any other segment of the reinforcing frame.

14. The sole according to claim 1, wherein the first end and the second end are spaced apart from each other by a distance ranging from at least 10% to at most 80% of a length of the sole.

15. The sole according to claim 1, wherein the first end is arranged in a toe region of the sole.

16. The sole according to claim 1, wherein the second end is arranged in a midfoot region of the sole.

17. The sole according to claim 1, wherein a width of the midfoot segment is greater than any other width of the reinforcing frame, the width being substantially in a plane defined by a heel to toe axis and a medial to lateral axis of the sole.

18. The sole according to claim 1, wherein the sole comprises an outsole, and wherein the outsole has a cut-out arranged such that the reinforcing frame is at least partially visible from below the outsole.

19. The sole according to claim 1, wherein the reinforcing frame is visible from a medial side, a heel side and/or a lateral side of the sole.

20. A shoe, comprising:

a sole according to claim 1; and an upper attached to the sole.

21. A sole for a shoe, the sole comprising:

an outsole;

a midsole comprising an upper midsole layer and a lower midsole layer; and a reinforcing frame sandwiched between the upper midsole layer and the lower midsole layer, wherein at least a first part of the reinforcing frame substantially surrounds an outer boundary of the midsole in one or more of: a lateral side region, a medial side region, a heel region, and a toe region of the midsole thereby defining an open space, wherein the reinforcing frame comprises an open frame structure having a first end and a second end, wherein the first end and the second end are spaced apart from each other, wherein the reinforcing frame has the following segments in the following order from the first end to the second end: a substantially straight lateral segment, a curved heel segment, a substantially straight medial segment, a curved toe segment, and a substantially straight midfoot segment, wherein a part of the midsole is received in the open space, wherein the lower midsole layer has a cut-out arranged such that the reinforcing frame is at least partially visible from below the lower midsole layer, and wherein the outsole has a cut-out arranged such that the reinforcing frame is at least partially visible from below the outsole.

* * * * *